US011515622B2

(12) United States Patent
Hou et al.

(10) Patent No.: US 11,515,622 B2
(45) Date of Patent: Nov. 29, 2022

(54) BASE STATION ANTENNAS HAVING MULTIBAND BEAM-FORMER ARRAYS AND RELATED METHODS OF OPERATION

(71) Applicant: CommScope Technologies LLC, Hickory, NC (US)

(72) Inventors: XiaoHua Hou, Richardson, TX (US); Chengcheng Tang, Murphy, TX (US); Xiangyang Ai, Plano, TX (US); Peter J. Bisiules, LaGrange Park, IL (US); Mohammad Vatankhah Varnoosfaderani, Richardson, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/927,580

(22) Filed: Jul. 13, 2020

(65) Prior Publication Data

US 2021/0021019 A1 Jan. 21, 2021

Related U.S. Application Data

(60) Provisional application No. 62/944,095, filed on Dec. 5, 2019, provisional application No. 62/883,279, filed on Aug. 6, 2019, provisional application No. 62/874,525, filed on Jul. 16, 2019.

(51) Int. Cl.

| | |
|---|---|
| ***H01Q 1/24*** | (2006.01) |
| ***H01Q 5/307*** | (2015.01) |
| ***H01Q 3/30*** | (2006.01) |
| ***H01Q 21/26*** | (2006.01) |

(Continued)

(52) U.S. Cl.
CPC ..... *H01Q 1/246* (2013.01); *H01Q 3/30* (2013.01); *H01Q 5/307* (2015.01); *H01Q 5/42* (2015.01); *H01Q 21/061* (2013.01); *H01Q 21/26* (2013.01)

(58) Field of Classification Search
CPC ..... H01Q 1/246; H01Q 3/30; H01Q 5/307; H01Q 21/26; H01Q 5/42; H01Q 21/061; H01Q 21/24; H01Q 21/28; H01Q 25/001
See application file for complete search history.

(56) References Cited

U.S. PATENT DOCUMENTS 3,522,610 A * 8/1970 Schroeder ..... H01Q 25/002 342/371
6,351,243 B1 * 2/2002 Derneryd ..... H01Q 3/26 343/754
10,601,120 B2 3/2020 Bisiules et al.
(Continued)

FOREIGN PATENT DOCUMENTS

WO 2017/165512 A1 9/2017

OTHER PUBLICATIONS

Extended European Search Report corresponding to European Application No. 20185856.0 (10 pages) (dated Nov. 27, 2020).

*Primary Examiner* — Andrea Lindgren Baltzell
*Assistant Examiner* — Yonchan J Kim
(74) *Attorney, Agent, or Firm* — Myers Bigel, P.A.

(57) ABSTRACT

Base station antennas are provided herein. A base station antenna includes a multiband beam-former array having a plurality of vertical columns of radiating elements. In some embodiments, at least two of the vertical columns are commonly fed for a first frequency band of the multiband beam-former array that is lower than a second frequency band of the multiband beam-former array. Related methods of operation are also provided.

19 Claims, 18 Drawing Sheets

(51) Int. Cl.
*H01Q 21/06* (2006.01)
*H01Q 5/42* (2015.01)

(56) References Cited

U.S. PATENT DOCUMENTS

| | | | | |
|---|---|---|---|---|
| 2006/0114168 | A1* | 6/2006 | Gottl | H01Q 21/08 343/810 |
| 2007/0205955 | A1 | 9/2007 | Korisch et al. | |
| 2010/0309084 | A1* | 12/2010 | Bu | H01Q 21/08 343/824 |
| 2015/0255881 | A1 | 9/2015 | Bi et al. | |
| 2015/0318876 | A1* | 11/2015 | Resnati | H01Q 21/08 370/297 |
| 2016/0087349 | A1 | 3/2016 | Lee et al. | |
| 2018/0323516 | A1* | 11/2018 | Zimmerman | H01Q 21/06 |
| 2018/0367199 | A1 | 12/2018 | Zimmerman | |
| 2022/0069883 | A1* | 3/2022 | Kaspersson | H04B 7/0608 |

* cited by examiner

BASE STATION ANTENNAS HAVING MULTIBAND BEAM-FORMER ARRAYS AND RELATED METHODS OF OPERATION

CROSS-REFERENCE TO RELATED APPLICATIONS

The present application claims priority to U.S. Provisional Patent Application Nos. 62/874,525, filed Jul. 16, 2019; 62/883,279, filed Aug. 6, 2019; and 62/944,095, filed Dec. 5, 2019, the entire content of each of which is incorporated herein by reference.

FIELD

The present disclosure relates to communication systems and, in particular, to base station antennas.

BACKGROUND

Base station antennas for wireless communication systems are used to transmit Radio Frequency ("RF") signals to, and receive RF signals from, fixed and mobile users of a cellular communications service. Base station antennas often include a linear array or a two-dimensional array of radiating elements, such as crossed dipole or patch radiating elements.

Example base station antennas are discussed in International Publication No. WO 2017/165512 and U.S. patent application Ser. No. 15/921,694, the disclosures of which are hereby incorporated herein by reference in their entireties. A base station antenna that includes many closely-spaced radiating elements may present performance trade-offs for the antenna. For example, though it may be desirable for a base station antenna to operate in multiple frequency bands, space in the antenna for additional radiating elements to provide multiband performance may be limited.

SUMMARY

A base station antenna, according to some embodiments herein, may include a plurality of first frequency band ports and a plurality of second frequency band ports. The first frequency band may be lower than the second frequency band. Moreover, the base station antenna may include a multiband beam-former array having a plurality of vertical columns of radiating elements. At least two of the plurality of vertical columns may be commonly fed by a first of the first frequency band ports.

In some embodiments, for the first frequency band, all of the plurality of vertical columns of radiating elements may be used for beam-forming. For the second frequency band, a majority of the plurality of vertical columns of radiating elements may be used for beam-forming and at least one of the plurality of vertical columns of radiating elements may not be used for beam-forming.

According to some embodiments, the plurality of vertical columns of radiating elements may include: first, second, third, and fourth vertical columns that are each configured to transmit RF signals in both the first frequency band and the second frequency band; and a fifth vertical column that is configured to transmit RF signals in the first frequency band and not in the second frequency band. The second and third vertical columns may be commonly fed for the first frequency band. Moreover, the first through fifth vertical columns may be five consecutive vertical columns.

In some embodiments, a center point of a radiating element of the second vertical column may be spaced apart from a center point of a corresponding radiating element of the third vertical column by a first distance. A center point of a radiating element of the fifth vertical column may be spaced apart from a center point of a corresponding radiating element of the fourth vertical column by a second distance that is between 1.3 and 1.7 times the first distance. Moreover, the first distance may be equal to about half of a wavelength of the second frequency band, and the second distance may be equal to about half of a wavelength of the first frequency band.

According to some embodiments, the plurality of vertical columns of radiating elements may include eleven vertical columns including: eight consecutive vertical columns that are each configured to transmit RF signals in both the first frequency band and the second frequency band; and three vertical columns that are configured to transmit RF signals in the first frequency band and not in the second frequency band. Five of the eleven vertical columns may be individually fed for the first frequency band, a first pair of the eleven vertical columns may be commonly fed for the first frequency band, a second pair of the eleven vertical columns may be commonly fed for the first frequency band, and a third pair of the eleven vertical columns may be commonly fed for the first frequency band. A first of the five individually fed vertical columns may be between the first pair and the second pair, and a second of the five individually fed vertical columns may be between the second pair and the third pair. Moreover, an outermost one of the eleven vertical columns may be one of the three vertical columns and may have a radiating element having a center point that is spaced apart from a center point of a corresponding radiating element of a nearest adjacent one of the eleven vertical columns by a second distance that is between 1.3 and 1.7 times a first distance between center points of radiating elements of others of the eleven vertical columns.

In some embodiments, at least one of the plurality of vertical columns may be individually fed by a second of the first frequency band ports. At least one of the plurality of vertical columns may not be fed by any of the second frequency band ports. Moreover, each of the plurality of vertical columns that is fed by a respective one of the second frequency band ports may be individually fed thereby.

According to some embodiments, the radiating elements may include first radiating elements that are configured to operate at the first frequency band and second radiating elements that are configured to operate at the second frequency band. Each of the second radiating elements may be between a plurality of segments of a respective one of the first radiating elements. At least one of the plurality of vertical columns is configured to operate only at the first frequency band and does not include any of the second radiating elements. Moreover, the first radiating elements may be box dipole elements, respectively, and the box dipole elements may define acute angles relative to each other in consecutive ones of the plurality of vertical columns.

A base station antenna, according to some embodiments herein, may include three RF ports that are configured to generate three respective beam-generated signals having a first azimuth half power beamwidth ("HPBW"). The base station antenna may include a fourth RF port that is configured to generate a beam-generated signal having a second azimuth HPBW that is narrower than the first HPBW. The fourth RF port and the three RF ports may all be part of the same beam-former array and may be configured to operate in the same frequency band. The base station antenna may include three vertical columns of radiating elements that are electrically connected to the three RF ports, respectively. Moreover, the base station antenna may include a fourth vertical column of radiating elements that is electrically connected to the fourth RF port.

In some embodiments, the fourth vertical column may be between two of the three vertical columns. Moreover, the fourth vertical column may be a combined column including a pair of commonly-fed vertical columns of radiating elements.

A base station antenna, according to some embodiments herein, may include a beam-forming array having two vertical columns of radiating elements fed by the same radio port at a first frequency band of the beam-forming array that is lower than a second frequency band of the beam-forming array.

In some embodiments, the two vertical columns of radiating elements may be fed by two different radio ports, respectively, per polarization, at the second frequency band. Moreover, the base station antenna may include another vertical column of radiating elements that is fed by a first single radio port per polarization at the first frequency band and a second single radio port per polarization at the second frequency band.

A base station antenna, according to some embodiments herein, may include a plurality of vertical columns of radiating elements that are all in the same beam-former array. An outermost one of the plurality of vertical columns of radiating elements may have a radiating element having a center point that is spaced apart from a center point of a corresponding radiating element of a nearest adjacent one of the plurality of vertical columns of radiating elements by a second distance that is between 1.3 and 1.7 times a first distance between center points of radiating elements of others of the plurality of vertical columns of radiating elements.

In some embodiments, the base station antenna may be configured to share the plurality of vertical columns of radiating elements for beam-forming at first and second frequency bands. Moreover, a ratio of a center frequency of the second frequency band to a center frequency of the first frequency band may be between 1.3 and 1.7.

A method of operating a base station antenna, according to some embodiments herein, may include sharing a plurality of vertical columns of radiating elements for beam-forming at first and second frequency bands. A ratio of a center frequency of the second frequency band to a center frequency of the first frequency band may be between 1.3 and 1.7. Moreover, the sharing may include: using all of the plurality of vertical columns of radiating elements for beam-forming at the first frequency band; and using a majority of the plurality of vertical columns of radiating elements, while refraining from using at least one of the plurality of vertical columns of radiating elements, for beam-forming at the second frequency band.

In some embodiments, the at least one of the plurality of vertical columns of radiating elements may include an outermost one of the plurality of vertical columns of radiating elements. Moreover, the outermost one of the plurality of vertical columns of radiating elements may have a radiating element having a center point that is spaced apart from a center point of a corresponding radiating element of a nearest adjacent one of the plurality of vertical columns of radiating elements by a second distance that is between 1.3 and 1.7 times a first distance between center points of radiating elements of others of the plurality of vertical columns of radiating elements.

According to some embodiments, the plurality of vertical columns of radiating elements may include two vertical columns fed by the same radio port at the first frequency band. Moreover, the two vertical columns of radiating elements may be fed by two different radio ports, respectively, per polarization, at the second frequency band.

In some embodiments, the plurality of vertical columns of radiating elements may include: first, second, third, and fourth vertical columns that transmit RF signals in both the first frequency band and the second frequency band; and a fifth vertical column that transmits RF signals in the first frequency band and not in the second frequency band. Moreover, the second and third vertical columns may be commonly fed for the first frequency band.

A base station antenna, according to some embodiments herein, may include a plurality of vertical stacks of sub-arrays of radiating elements. A first of the vertical stacks may include: wideband radiating elements that are configured to transmit in both a lower frequency band and an upper frequency band; and low-band radiating elements that are configured to transmit in only the lower frequency band. A second of the vertical stacks may be configured to transmit in only the lower frequency band. Moreover, each sub-array may be coupled to one lower-band input port per polarization.

In some embodiments, each of the vertical stacks may include four sub-arrays of radiating elements.

According to some embodiments, the first and the second of the vertical stacks may each have a single vertical column of radiating elements. A third of the vertical stacks may have two commonly-fed vertical columns of radiating elements that are commonly fed for the lower frequency band.

In some embodiments, the single vertical column of the first of the vertical stacks may include a combined row of wideband radiating elements that is coupled to one upper-band input port per polarization. The combined row may include a first wideband radiating element of a first sub-array of the first of the vertical stacks and a second wideband radiating element of a second sub-array of the first of the vertical stacks. Moreover, the combined row may be one among a plurality of combined rows in the single vertical column of the first of the vertical stacks.

According to some embodiments, a bottom row of radiating elements may have low-band radiating elements that are in bottom sub-arrays that have fewer radiating elements than corresponding sub-arrays that vertically overlap the bottom sub-arrays. Alternatively, a top row of radiating elements may have low-band radiating elements that are in top sub-arrays that have fewer radiating elements than corresponding sub-arrays that are vertically overlapped by the top sub-arrays.

In some embodiments, the third of the vertical stacks may include a third vertical column of radiating elements that is horizontally centered with respect to the two commonly-fed vertical columns. The third vertical column may include: a first sub-array that is horizontally centered with respect to the two commonly-fed vertical columns; and a radiating element that is horizontally centered in a second sub-array of the two commonly-fed vertical columns. Moreover, the third of the vertical stacks further may include a third sub-array that is between the first sub-array and the second sub-array and that includes more radiating elements than either of the first sub-array and the second sub-array.

According to some embodiments, the second of the vertical stacks may have few radiating elements per vertical column than the first of the vertical stacks. Moreover, radiating elements in the second of the vertical stacks may have a larger vertical spacing than radiating elements in the first of the vertical stacks.

In some embodiments, a top (or bottom) sub-array of the first of the vertical stacks may have a plurality of wideband radiating elements in a plurality of vertical columns and a single low-band radiating element that is horizontally offset from the plurality of vertical columns. Moreover, the plurality of vertical columns and the single low-band radiating element may be commonly fed for the lower frequency band.

According to some embodiments, the sub-arrays may be on different respective feed boards. Moreover, a sub-array in the second of the vertical stacks may be coupled to only one power divider per polarization.

BRIEF DESCRIPTION OF THE DRAWINGS

FIG. 2I is a schematic block diagram of the ports of FIGS. 2F-2H electrically connected to ports of a radio.

DETAILED DESCRIPTION

Pursuant to embodiments of the present inventive concepts, base station antennas for wireless communication networks are provided. In wireless communications, it may be desirable to use base station antennas having beam-forming arrays with multiple vertical columns of radiating elements. Beam-forming arrays can actively change the size and/or pointing direction of the antenna beam generated by the array, which can provide increased antenna gain and reduced interference.

As beam-forming arrays include multiple vertical columns (typically four or eight columns) of radiating elements, however, they occupy a large amount of space in the antenna. As a result, most base station antennas only have room for one or, at most, two beam-forming arrays. To implement beam-forming in multiple different cellular frequency bands, beam-forming arrays have been deployed that use so-called "wideband" radiating elements that can be used to transmit and receive RF signals in multiple different cellular frequency bands. As explained in greater detail below, however, such a design results in performance tradeoffs, as the spacing between columns that is ideal for beam-forming in a first frequency band will be less than ideal for beam-forming in other frequency bands. Though these performance limitations may be avoided by providing a different beam-forming array for each frequency band, space limitations typically preclude such an approach.

Accordingly, various embodiments of the present inventive concepts provide a base station antenna having a multiband beam-former array that re-uses some vertical columns of radiating elements at different frequency bands. For example, the multiband beam-former array may use all of the vertical columns for beam-forming at a lower frequency band and may re-use some, but not all, of the vertical columns for beam-forming at a higher frequency band. By re-using (i.e., "sharing") the vertical columns, the multiband beam-former array can reduce the size of the base station antenna or provide reflector space for radiating elements that operate in other frequency bands.

Moreover, for beam-forming, it may be desirable to have spacing between vertical columns of about half of a wavelength. With a multiband beam-former array, it may thus be desirable to have different spacing for different frequency bands (because a half wavelength will necessarily correspond to a different spacing at each different frequency). By commonly feeding some of the vertical columns at one of the frequency bands, along with using extended spacing for an outermost vertical column that corresponds to a ratio of center frequencies of the frequency bands, the present inventive concepts can advantageously provide different physical spacings for different frequency bands that are each close to a desired spacing while using shared vertical columns.

Example embodiments of the present inventive concepts will be described in greater detail with reference to the attached figures.

Figure 1:
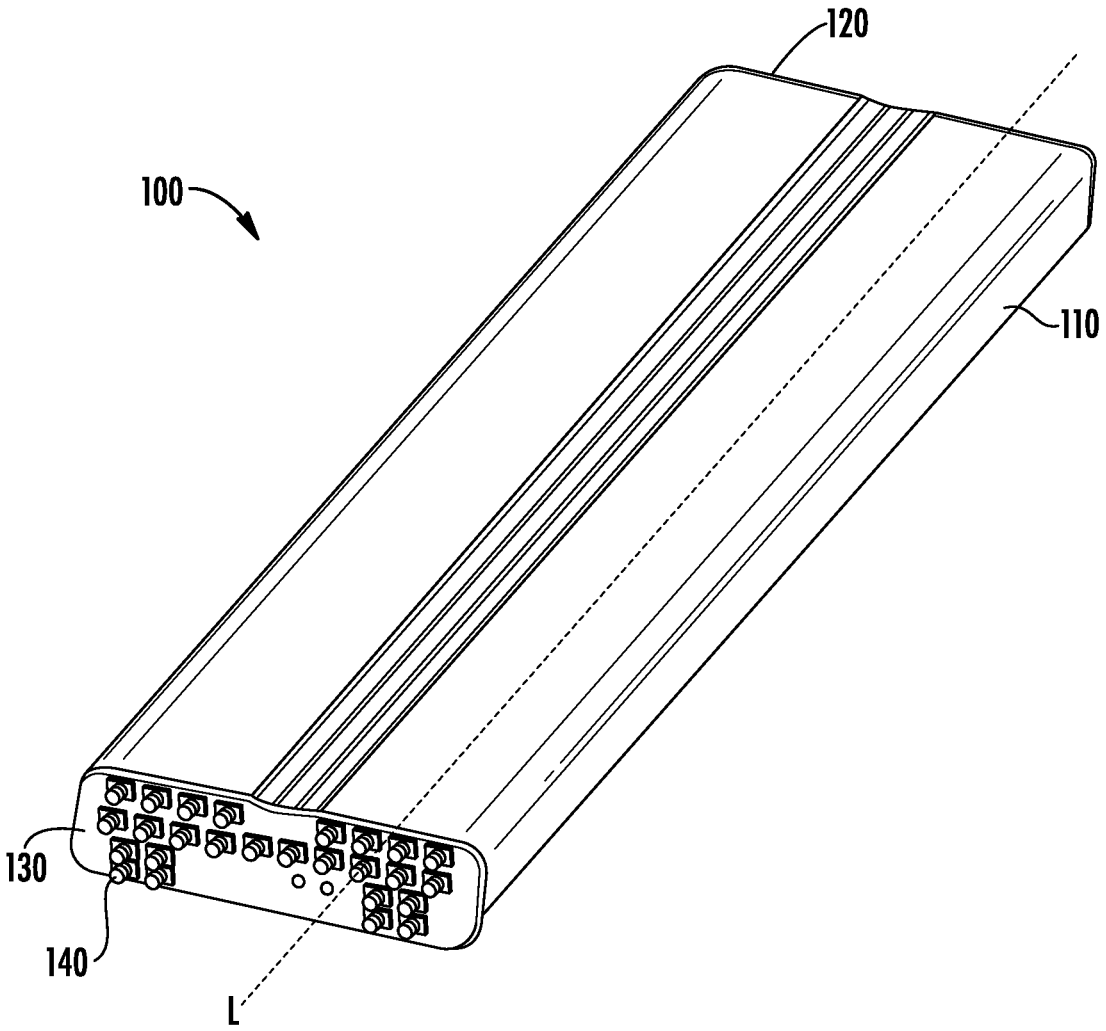
FIG. 1 is a front perspective view of a base station antenna according to embodiments of the present inventive concepts.

FIG. 1 is a front perspective view of a base station antenna 100 according to embodiments of the present inventive concepts. As shown in FIG. 1, the base station antenna 100 is an elongated structure and has a generally rectangular shape. The base station antenna 100 includes a radome 110. In some embodiments, the base station antenna 100 further includes a top end cap 120 and/or a bottom end cap 130. For example, the radome 110, in combination with the top end cap 120, may comprise a single unit, which may be helpful for waterproofing the base station antenna 100. The bottom end cap 130 is usually a separate piece and may include a plurality of connectors 140 mounted therein. The connectors 140 are not limited, however, to being located on the bottom end cap 130. Rather, one or more of the connectors 140 may be provided on the rear (i.e., back) side of the radome 110 that is opposite the front side of the radome 110. The base station antenna 100 is typically mounted in a vertical configuration (i.e., the long side of the base station antenna 100 extends along a vertical axis L with respect to Earth).

Figure 2A:
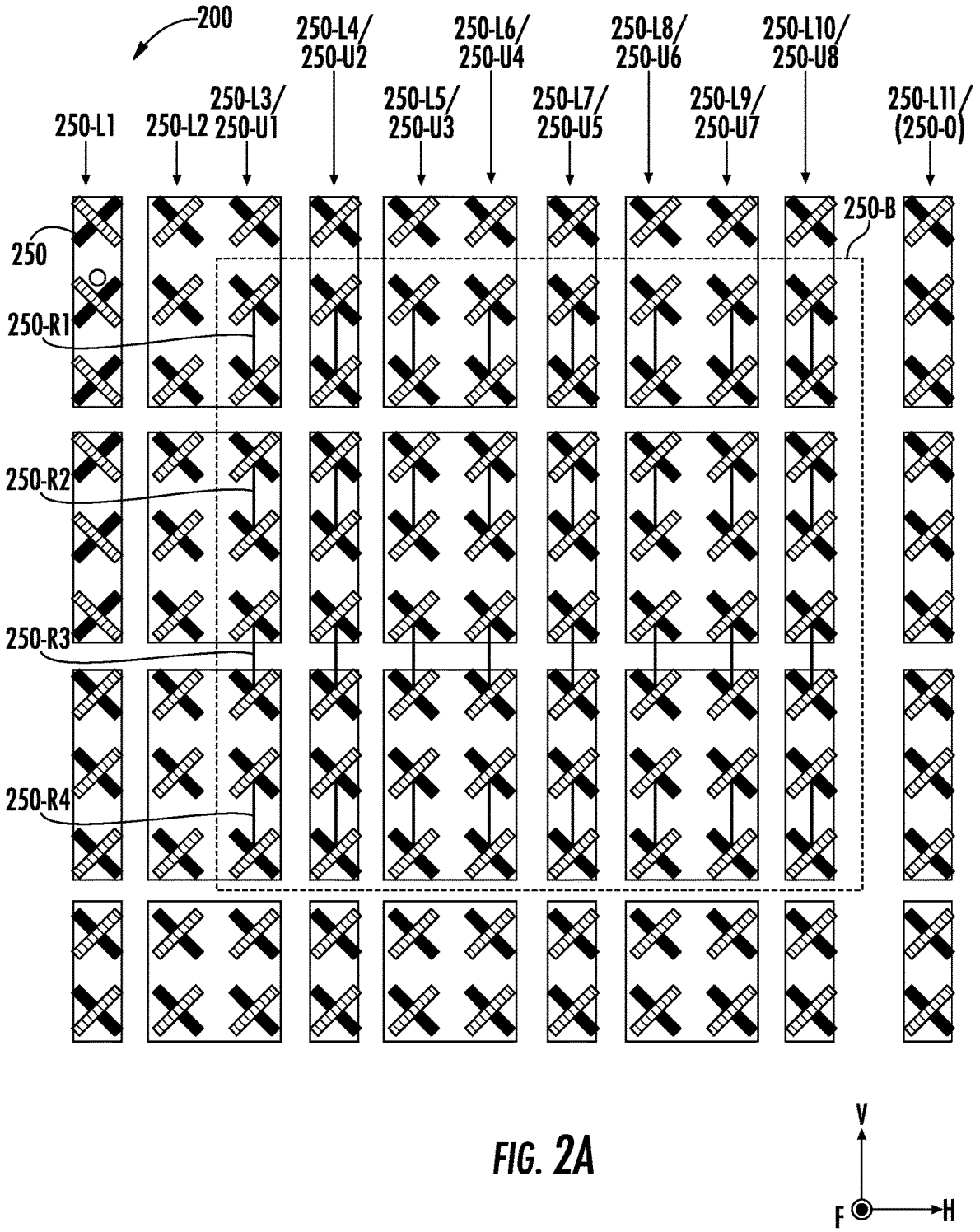
FIGS. 2A and 2B are example schematic front views of the base station antenna of FIG. 1 with the radome removed.

FIG. 2A is a schematic front view of the base station antenna 100 of FIG. 1 with the radome 110 thereof removed to illustrate an antenna assembly 200 of the antenna 100. The antenna assembly 200 includes a plurality of radiating elements 250, which may be grouped into one or more arrays, including one or more beam-forming arrays.

Vertical columns 250-U1 through 250-U8 of radiating elements 250 may extend in a vertical direction V from a lower portion of the antenna assembly 200 to an upper portion of the antenna assembly 200. The vertical direction V may be, or may be in parallel with, the longitudinal axis L (FIG. 1). The vertical direction V may also be perpendicular to a horizontal direction H and a forward direction F. As used herein, the term "vertical" does not necessarily require that something is exactly vertical (e.g., the antenna 100 may have a small mechanical down-tilt). The radiating elements 250 may extend forward in the forward direction F from one or more feeding (or "feed") boards 204 (FIG. 2E) that couple RF signals to and from the individual radiating elements 250. For example, the radiating elements 250 may, in some embodiments, be on the same feeding board 204. As an example, the feeding board 204 may be a single PCB having all of the radiating elements 250 thereon. More typically, a plurality of feeding boards 204 are provided, and one, two, or three radiating elements 250 are mounted on each feeding board 204. Cables may be used to connect each feeding board 204 to other components of the antenna 100, such as diplexers, phase shifters, or the like. While feeding boards 204 are used in the example of FIG. 2A, in other embodiments the radiating elements 250 may be mounted on a reflector and may be fed in any appropriate manner (e.g., by feed cables).

The vertical columns 250-U1 through 250-U8 are each configured to transmit RF signals in an upper frequency band. These eight consecutive vertical columns 250-U1 through 250-U8 are also each configured to transmit RF signals in a lower frequency band that is lower than the upper frequency band. Accordingly, the eight vertical columns 250-U1 through 250-U8 are designated in FIG. 2A as 250-L3/250-U1 through 250-L10/250-U8, to indicate that each of these columns is configured to transmit RF signals in both the upper frequency band and the lower frequency band. The radiating elements 250 are wideband radiating elements that are configured to transmit RF signals in both the upper and lower frequency bands. In some embodiments, however, different lower-band radiating elements 430 and upper-band radiating elements 440 (FIGS. 4A and 4B) may be used instead of wideband radiating elements.

The antenna assembly 200 also includes three vertical columns 250-L1, 250-L2, and 250-L11 that are configured to transmit RF signals in the lower frequency band but which may not transmit RF signals in the upper frequency band. The antenna assembly 200 may thus include eleven vertical columns, eight of which are shared for beam-forming at both the upper frequency band and the lower frequency band.

Though FIG. 2A illustrates eight vertical columns 250-U1 through 250-U8, the antenna assembly 200 may include more (e.g., nine, ten, or more) or fewer (e.g., seven, six, five, four, three, two, or one) vertical columns that are configured to transmit RF signals in the upper frequency band (and in the lower frequency band). Similarly, though FIG. 2A illustrates three lower-band-only vertical columns 250-L1, 250-L2, and 250-L11, the antenna assembly 200 may include more (e.g., four, five, or more) or fewer (e.g., one or two) vertical columns that are configured to transmit RF signals in the lower frequency band (and not in the upper frequency band). Moreover, the number of radiating elements 250 in a vertical column can be any quantity from two to twenty or more. For example, the eleven vertical columns shown in FIG. 2A may each have eight to twenty radiating elements 250. In some embodiments, the vertical columns may each have the same number (e.g., eleven) of radiating elements 250.

Radiating elements 250 of the vertical columns 250-U1 through 250-U8 may, in some embodiments, be configured to transmit and/or receive signals in an upper frequency band comprising one of the 3300-4200 megahertz ("MHz") and/or 5000-5900 MHz frequency ranges or a portion thereof. Also, radiating elements 250 of the vertical columns 250-L1 through 250-L11 may, in some embodiments, be configured to transmit and/or receive signals in a lower frequency band comprising one of the 2300-2690 MHz and/or 3300-4200 MHz frequency ranges or a portion thereof. In one example embodiment, the lower frequency band may comprise 2300-2690 MHz or a portion thereof and the upper frequency band may comprise 3300-3800 MHz or a portion thereof. In another example embodiment, the lower frequency band may comprise 3300-3800 MHz or a portion thereof and the upper frequency band may comprise 5000-5900 MHz or a portion thereof. Though examples herein discuss two frequency bands (e.g., upper and lower), the shared vertical columns 250-L/250-U may, in some embodiments, be configured to perform beam-forming in three or more frequency bands.

In some embodiments, the radiating elements 250 may be used in a beam-forming mode to transmit RF signals where the antenna beam is "steered" in at least one direction. Examples of antennas that may be used as beam-forming antennas are discussed in U.S. Patent Publication No. 2018/0367199, the disclosure of which is hereby incorporated herein by reference in its entirety. For example, a base station may include a beam-forming radio that has a plurality of output ports that are electrically connected to respective ports of a base station antenna. Moreover, though FIG. 2A illustrates non-staggered vertical columns 250-U and 250-L, the vertical columns 250-U and 250-L may alternatively be staggered relative to each other in the vertical direction V.

FIG. 2A also shows that the shared vertical columns 250-L3/250-U1 through 250-L10/250-U8 may, in some embodiments, include both (a) radiating elements 250 configured to perform beam-forming at the lower frequency band only and (b) radiating elements 250 configured to perform beam-forming at both the upper frequency band and the lower frequency band. For example, the antenna assembly 200 may include a multiband beam-forming array 250-B of the (b) radiating elements 250 configured to perform beam-forming at both the upper frequency band and the lower frequency band. By contrast, the (a) radiating elements 250 configured to perform beam-forming at the lower frequency band only are in the antenna assembly 200 but outside of the beam-forming array 250-B. The beam-forming array 250-B may, in some embodiments, be a sub-array of a larger beam-forming array that also includes the (a) radiating elements 250 configured to perform beam-forming at the lower frequency band only.

In some embodiments, each vertical column in the beam-forming array 250-B may include four combined rows 250-R1 through 250-R4 of radiating elements 250, where each combined row includes two radiating elements 250 per vertical column. For example, the beam-forming array 250-B may provide 4×8 beam-forming (using 64T64R radios) with two polarizations. Alternatively, the beam-forming array 250-B may provide 8×8 beam-forming or another configuration. Specifically, the beam-forming array 250-B (or another array of radiating elements 250) can be expanded to any 1D or 2D antenna array.

Figure 2B:
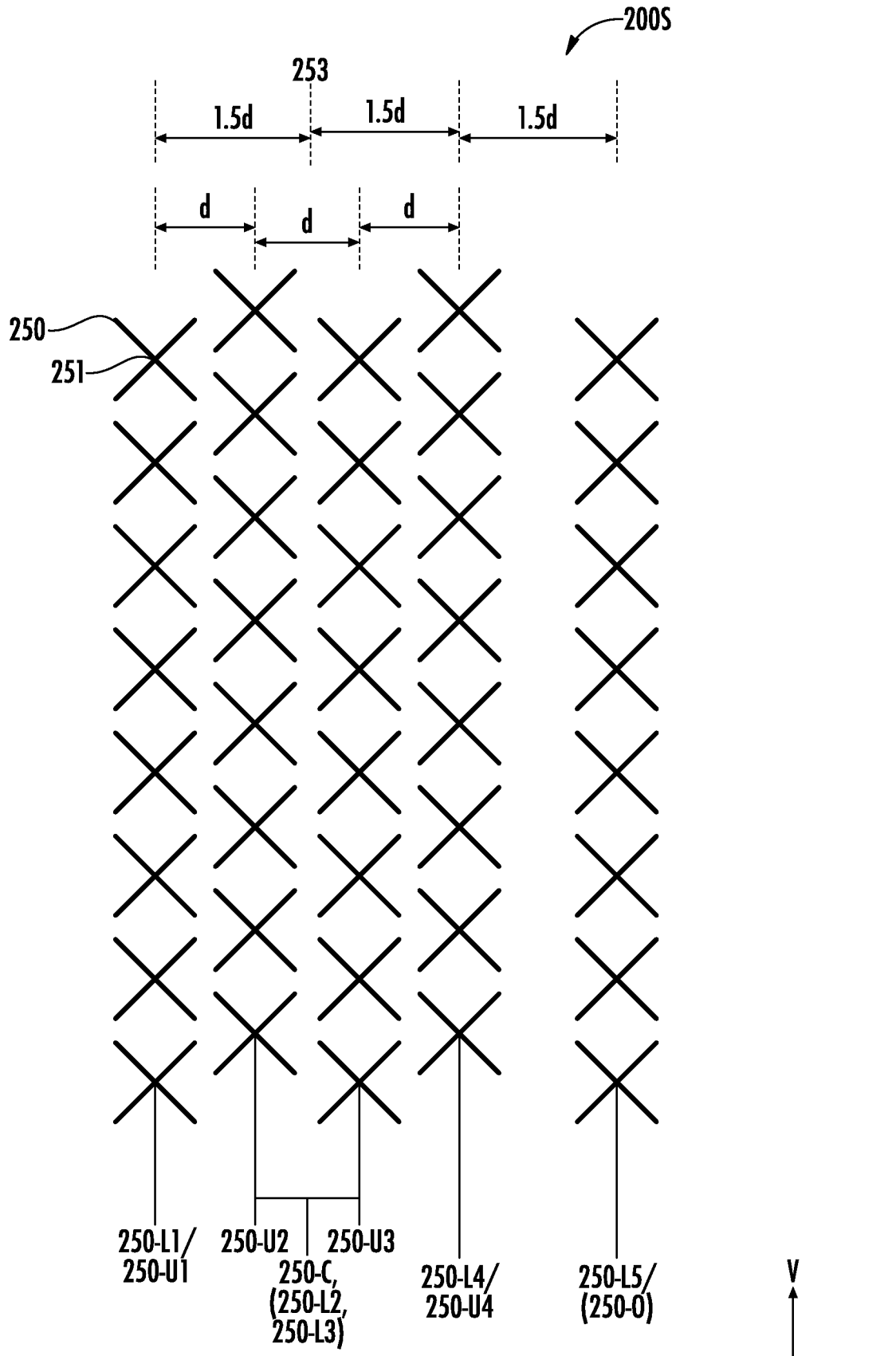

FIG. 2B is a schematic front view of the base station antenna 100 of FIG. 1 with the radome 110 thereof removed to illustrate an antenna assembly 200S of the antenna 100. In contrast with the example in FIG. 2A in which the antenna 100 includes an antenna assembly 200 having eight vertical columns 250-U1 through 250-U8 and three vertical columns 250-L1, 250-L2, and 250-L11, the antenna assembly 200S of FIG. 2B has four vertical columns 250-U1 through 250-U4 and one vertical column 250-L5. In particular, the four consecutive vertical columns 250-U1 through 250-U4 may be shared for beam-forming at both the upper frequency band and the lower frequency band, whereas the vertical column 250-L5 may be configured to perform beam-forming at the lower frequency band only. The four shared vertical columns can also be designated as 250-L1/250-U1 through 250-L4/250-U4.

The antenna 100 may thus use the antenna assembly 200S (or the antenna 200 of FIG. 2A) as a multiband beam-former array having a plurality of vertical columns 250-L and 250-U, at least two of which are commonly fed for a first frequency band of the multiband beam-former that is lower than a second frequency band of the multiband beam-former array. All of the vertical columns 250-L and 250-U may be used for beam-forming at the first frequency band. By contrast, for beam-forming at the second frequency band, a majority (i.e., more than half) of the vertical columns 250-L and 250-U may be used and at least one (e.g., the vertical column 250-L5 of FIG. 2B) may not be used.

FIG. 2B also shows that the vertical columns 250-L1/250-U1 through 250-L4/250-U4 and 250-L5 may have a staggered arrangement. In particular, consecutive ones of the vertical columns 250-L1/250-U1 through 250-L4/250-U4 and 250-L5 may be vertically staggered relative to each other. For example, center points 251 of radiating elements 250 of the vertical column 250-L1/250-U1 may be staggered relative to corresponding center points 251 of the vertical column 250-L2/250-U2 in the vertical direction V. Also, the center points 251 of the vertical column 250-L2/250-U2 may be vertically staggered relative to corresponding center points 251 of the vertical column 250-L3/250-U3.

In some embodiments, non-consecutive ones of the vertical columns 250-L1/250-U1 through 250-L4/250-U4 and 250-L5 may not be vertically staggered relative to each other. For example, center points 251 of the vertical column 250-L3/250-U3 may be aligned with corresponding center points 251 of the vertical columns 250-L1/250-U1 and 250-L5 in the horizontal direction H. Similarly, center points 251 of the vertical column 250-L2/250-U2 may be aligned with corresponding center points 251 of the vertical column 250-L4/250-U4 in the horizontal direction H. As used herein, the term "vertical" (or "vertically") refers to something (e.g., a distance, axis, or column) in the vertical direction V. Moreover, a feed point may, in some embodiments, be at or adjacent the center point 251 of a radiating element 250.

Though FIG. 2B is shown as a staggered example and FIG. 2A is shown as a non-staggered example, these two examples may be reversed. Accordingly, the eight vertical columns 250-U1 through 250-U8 and three vertical columns 250-L1, 250-L2, and 250-L11 of the antenna assembly 200 (FIG. 2A) may be staggered, and the four vertical columns 250-U1 through 250-U4 and one vertical column 250-L5 of the antenna assembly 200S (FIG. 2B) may be non-staggered.

Also, though FIG. 2B illustrates a single vertical column 250-L5 that performs beam-forming only at the lower frequency band, a plurality of such vertical columns may be included in the antenna assembly 200S. For example, in some embodiments, a sixth lower-band vertical column (e.g., a duplicate of the vertical column 250-L5) may be to the left of the four shared vertical columns 250-L1/250-U1 through 250-L4/250-U4, so that the four shared vertical columns 250-L1/250-U1 through 250-L4/250-U4 are between two single-frequency-band vertical columns. For symmetry with the vertical column 250-L5, radiating elements 250 of the sixth lower-band vertical column may have center points that are a distance of about 1.5d from corresponding center points 251 of the vertical column 250-L1. In some embodiments, this distance may be between 1.3 and 1.7 times a distance d.

Figure 2C:
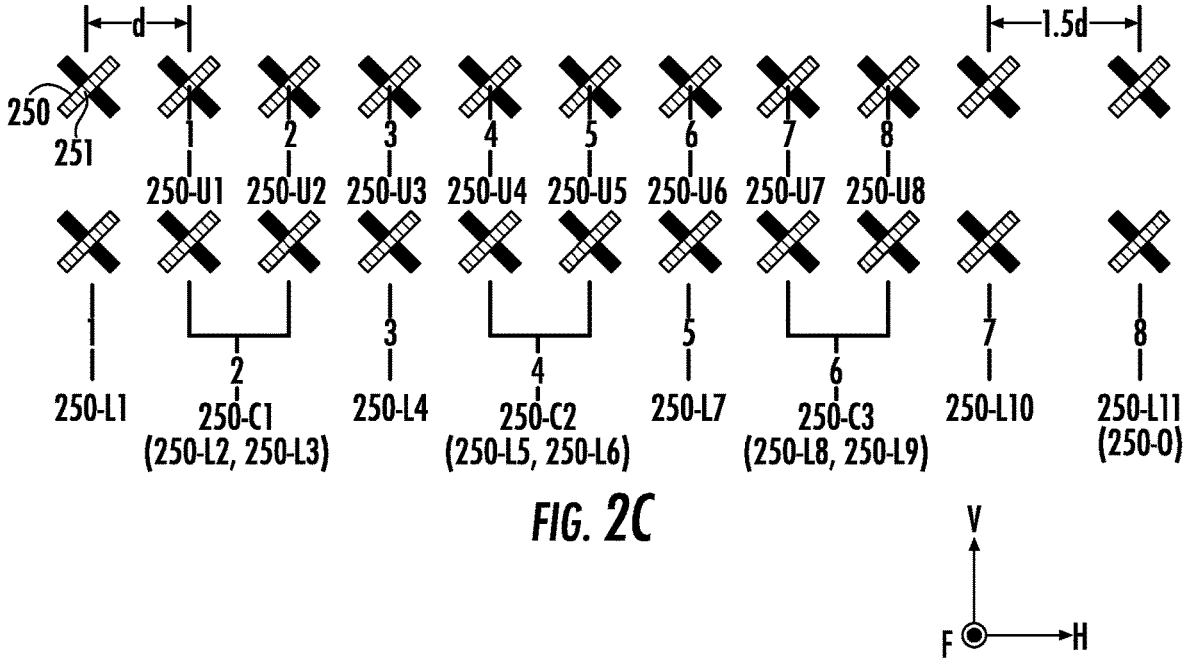
FIGS. 2C and 2D are detailed schematic front views of portions of antenna assemblies of FIGS. 2A and 2B, respectively.

FIG. 2C is a detailed schematic front view of a portion of the antenna assembly 200 of FIG. 2A with a different group of shared vertical columns. FIG. 2C shows that the vertical columns 250-L2/250-U1 through 250-L9/250-U8 are shared for beam-forming at both the upper frequency band and the lower frequency band, whereas FIG. 2A shows the vertical columns 250-L3/250-U1 through 250-L10/250-U8 as being shared. Also, in FIG. 2C, the three vertical columns 250-L1, 250-L10, and 250-L11 are configured to provide beam-forming at the lower frequency band only (in comparison with the three vertical columns 250-L1, 250-L2, and 250-L11 in FIG. 2A). Shared vertical columns can thus be grouped as shown in FIG. 2A or as shown in FIG. 2C. Though FIG. 2C only shows two radiating elements 250 per vertical column to simplify the drawings, as noted above, each vertical column may have between two and twenty, or more, radiating elements 250.

FIGS. 2A and 2C also show that some of the vertical columns 250-L of the antenna assembly 200 may be commonly fed for the lower frequency band. For example, rectangular shapes in FIG. 2A that surround radiating elements 250 of multiple vertical columns indicate that those vertical columns are commonly fed for the lower frequency band. Specifically, the vertical columns 250-L2 and 250-L3 are commonly fed in FIG. 2A, as are the vertical columns 250-L5 and 250-L6 and the vertical columns 250-L8 and 250-L9. In FIG. 2C, these three pairs of commonly-fed vertical columns are designated as 250-C1, 250-C2, and 250-C3, respectively. The five vertical columns 250-L1, 250-L4, 250-L7, 250-L10, and 250-L11, by contrast, are each individually fed for the lower frequency band. Also, the eight vertical columns 250-U1 through 250-U8 are each individually fed for the upper frequency band.

A pair of columns are commonly fed if both columns are coupled to the same port on an antenna. By contrast, a column is individually fed if it does not share the same port with another column. Thus, for example, vertical columns 250-L5/250-U3 and 250-L6/250-U4 shown in FIG. 2A may both be coupled to the same lower frequency band RF port 140-L (FIG. 2H) on the antenna 100 because they are commonly fed for the lower frequency band, but may be coupled to respective first and second upper frequency band RF ports 140-U (FIG. 2I) because they are individually fed for the upper frequency band.

Because they are commonly fed, the vertical columns 250-C1, 250-C2, and 250-C3 correspond to beam-generated signals having a narrower azimuth beamwidth than the individually-fed vertical columns 250-L1, 250-L4, 250-L7, 250-L10, and 250-L11 for beam-forming at the lower frequency band. For example, the narrower azimuth beamwidth may be about forty-five degrees, whereas the azimuth beamwidth provided by individual feeding may be about ninety degrees.

Each beam-generated signal is generated at an RF port 140. Specifically, three RF ports 140-L1, 140-L4, and 140-

L5 (FIG. 2I) generate three respective beam-generated signals having a first azimuth HPBW, and a fourth RF port 140-L2/L3 (FIG. 2I) generates a beam-generated signal having a second azimuth HPBW that is narrower than the first HPBW. All four RF ports 140-L1, 140-L2/L3, 140-L4, and 140-L5 are part of the same beam-former array and operate in the same frequency band.

As illustrated in FIG. 2C, center points 251 of radiating elements 250 in most (e.g., all but one) of the vertical columns may be spaced apart from each other in the horizontal direction H by a distance d. An outermost vertical column 250-L11 (250-O), however, may be spaced apart from the nearest adjacent vertical column 250-L10 in the horizontal direction H by a larger distance of about 1.5d. The coefficient of this larger distance of about 1.5d (or between 1.3 and 1.7 times the distance d) may be close to a ratio of (i) a center frequency of the upper frequency band to (ii) a center frequency of the lower frequency band, and thus may facilitate acceptable performance (e.g., may avoid excessive mutual coupling) at both frequency bands. For example, the ratio may be between 1.4 and 1.6 or between 1.3 and 1.7. As an example, a center frequency of 3550 MHz (of an upper frequency band of 3300-3800 MHz) and a center frequency of 2495 MHz (of a lower frequency band of 2300-2690 MHz) have a ratio of 1.42. Similarly, a center frequency of 5450 MHz (of an upper frequency band of 5000-5900 MHz) and a center frequency of 3550 MHz (of a lower frequency band of 3300-3800 MHz) have a ratio of 1.53. Any two (or more) frequency bands with a ratio of center frequencies between about 1.4 and 1.6 (or between about 1.3 and 1.7) may be used. Also, as used herein, the term "outermost" refers to a leftmost or rightmost, in the horizontal direction H, vertical column 250-L that may be spaced by the larger distance of about 1.5d.

The distance d may be equal to about half of a wavelength of the upper frequency band, and the larger distance of about 1.5d may be equal to about half of a wavelength of the lower frequency band. As used herein, the term "about half" refers to a value between 0.4 and 0.6 times the wavelength. For example, the distance d may be about 40 millimeters ("mm"), and the larger distance of 1.5d may be about 60 mm, when the upper frequency band is 3300-3800 MHz and the lower frequency band is 2300-2690 MHz. Moreover, as shown in FIG. 2C, the individually-fed vertical column 250-L4 may be between the first pair of commonly-fed vertical columns 250-C1 and the second pair of commonly-fed vertical columns 250-C2, and the individually-fed vertical column 250-L7 may be between the second pair of commonly-fed vertical columns 250-C2 and the third pair of commonly-fed vertical columns 250-C3. As a result, midpoints (i.e., "virtual centers") of the three pairs of commonly-fed vertical columns 250-C1, 250-C2, and 250-C3 may be spaced apart from center points 251 of adjacent, individually-fed vertical columns 250-L by the larger distance of about 1.5d in the horizontal direction H. These midpoints may also be respective phase centers. The lower-band vertical columns 250-L1, 250-C1, 250-L4, 250-C2, 250-L7, 250-C3, 250-L10, and 250-O can thus be spaced apart from each other in the horizontal direction H by about half of a wavelength of the lower frequency band. Also, the upper-band vertical columns 250-U1 through 250-U8 may be spaced apart from each other in the horizontal direction H by about half of a wavelength of the upper frequency band.

In some embodiments, midpoints, in the vertical direction V, of the combined rows 250-R1 through 250-R4 shown in FIG. 2A may be spaced apart from each other by the larger distance of about 1.5d in the vertical direction V for beam-forming at the lower frequency band. By contrast, center points 251 of the radiating elements 250 may be spaced apart from each other by the distance d in the vertical direction V for beam-forming at the upper frequency band. Accordingly, the different distances d and 1.5d may, in some embodiments, be used in the vertical direction V and/or in the horizontal direction H. Moreover, center points 251 of a low-band-only row (e.g., the top or bottom row in the antenna assembly 200) of radiating elements 250 may, in some embodiments, be spaced apart from center points 251 of the nearest adjacent row by the larger distance of 1.5d in the vertical direction V. For example, respective bottom rows (or respective top rows) of antenna assemblies 500, 500N, and 500T (FIGS. 5B-5D) have the larger spacing of 1.5d in the vertical direction V.

Figure 2D:
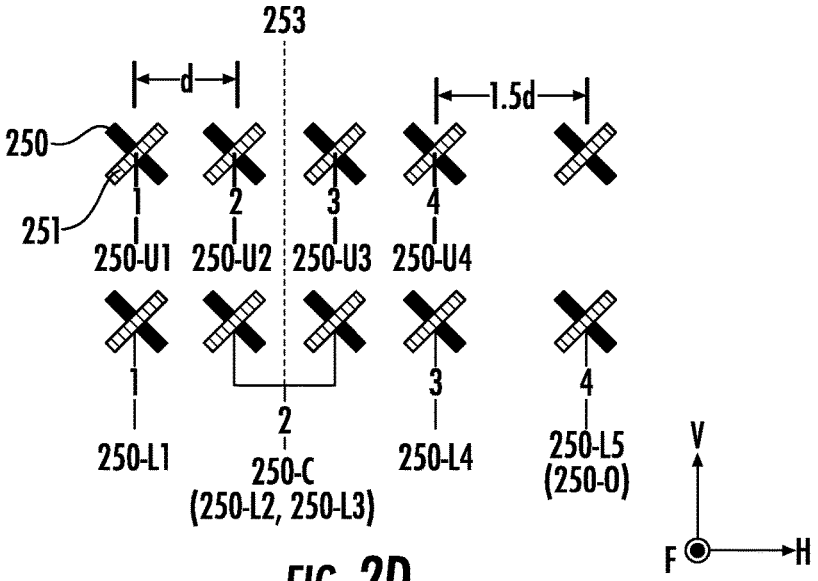

FIG. 2D is a detailed schematic front view of a portion of the antenna assembly 200S of FIG. 2B with the vertical staggering thereof omitted. FIGS. 2B and 2D illustrate commonly-fed lower-band vertical columns 250-L2 and 250-L3 that are between individually-fed lower-band vertical columns 250-L1 and 250-L4. Because they are commonly-fed, the lower-band vertical columns 250-L2 and 250-L3 may have a narrower (e.g., by about half) azimuth beamwidth and may be collectively referred to herein as a "combined" vertical column 250-C that has a virtual center 253. Due to the combined vertical column 250-C, the five lower-band vertical columns 250-L1 through 250-L5 may also be considered four lower-band vertical columns 250-L1, 250-C, 250-4, and 250-L5.

Though various examples herein show upper frequency band vertical columns 250-U that are uniformly spaced apart from each other by the distance d, as well as lower frequency band vertical columns 250-L that are uniformly spaced apart by the larger distance of 1.5d, the vertical columns 250-U and/or the vertical columns 250-L may be non-uniformly spaced apart. For example, center points 251 of radiating elements 250 of the vertical column 250-L1 may, in some embodiments, be spaced apart from the virtual center 253 of the combined vertical column 250-C by a first distance in the horizontal direction H that is unequal to a second distance in the horizontal direction H by which the virtual center 253 is spaced apart from center points 251 of radiating elements 250 of the vertical column 250-L4.

As with the virtual centers of the three pairs of commonly-fed vertical columns 250-C1, 250-C2, and 250-C3 of FIG. 2C, the virtual center 253 of FIGS. 2B and 2D may be spaced apart from center points 251 of adjacent lower-band vertical columns 250-L1 and 250-L4 by a distance of about 1.5d in the horizontal direction H. Also, a center point 251 of an outermost lower-band vertical column 250-O (250-L5 in FIGS. 2B and 2D) may be spaced apart from a center point 251 of its nearest adjacent lower-band vertical column 250-L4 by the distance of about 1.5d in the horizontal direction H. The lower-band vertical columns 250-L1, 250-C, 250-L4, and 250-O can thus be spaced apart from each other in the horizontal direction H by about half of a wavelength of the lower frequency band. Such wavelength spacing (of about 0.5) can facilitate scanning a service beam a large distance in the azimuth plane while suppressing/avoiding grating lobes.

To simplify the illustration of the distances d and 1.5d, FIGS. 2C and 2D label some of the vertical columns of radiating elements 250 using the single reference designator "250-U" and others using the single reference designator "250-L." As shown in FIGS. 2A and 2B, however, any vertical column 250-U that operates at the upper frequency band can be jointly designated as "250-L/250-U" because it also operates at the lower frequency band. By contrast, at least one of the lower frequency band vertical columns 250-L (e.g., an outermost vertical column 250-O) operates only at the lower frequency band. FIGS. 2A-2D also illustrate that the vertical columns 250-L1 through 250-L5 (or 250-L1 through 250-L11) may be consecutive vertical columns in the horizontal direction H that do not have intervening vertical columns of radiating elements therebetween.

Figure 2E:
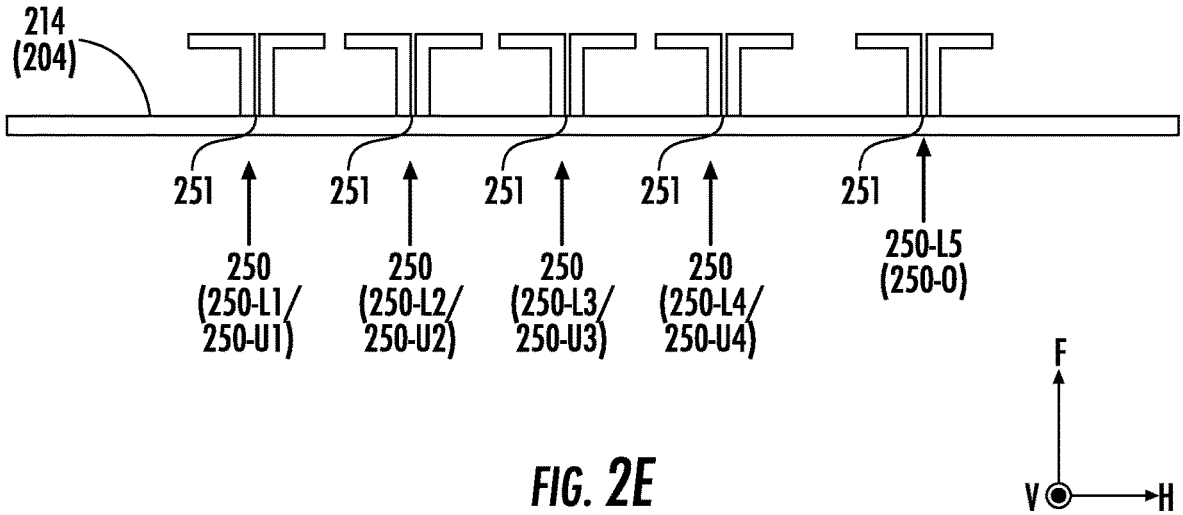
FIG. 2E is a schematic profile view of the radiating elements of FIG. 2B.

FIG. 2E is a schematic profile view of the radiating elements 250 of FIG. 2B. The profile view shows a "row" of the radiating elements 250 along the horizontal direction H. The row includes a first radiating element 250 in the vertical column 250-L1/250-U1, a second radiating element 250 in the vertical column 250-L2/250-U2, a third radiating element 250 in the vertical column 250-L3/250-U3, a fourth radiating element 250 in the vertical column 250-L4/250-U4, and a fifth radiating element 250 in the vertical column 250-L5.

As shown in FIG. 2E, the radiating elements 250 may extend in the forward direction F from a ground plane reflector 214. Feeding board(s) 204 may be located forward or rearward of the reflector 214.

Various mechanical and electronic components of the antenna 100 (FIG. 1) may be mounted in a chamber behind a back side of the reflector surface 214. The components may include, for example, phase shifters, remote electronic tilt units, mechanical linkages, a controller, diplexers, and the like. The reflector surface 214 may comprise a metallic surface that serves as a reflector and ground plane for the radiating elements 250 of the antenna 100. Herein, the reflector surface 214 may also be referred to as the reflector 214.

Figure 2F:
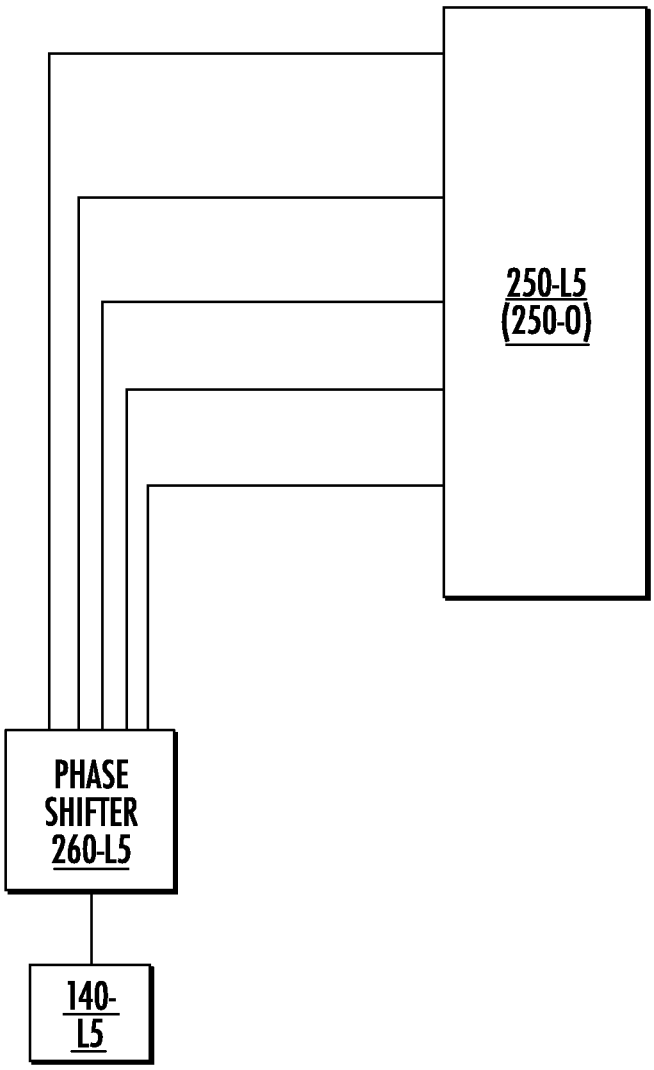
FIG. 2F is a schematic block diagram of a vertical column of FIG. 2B electrically connected to a lower-band antenna port.
Figure 2G:
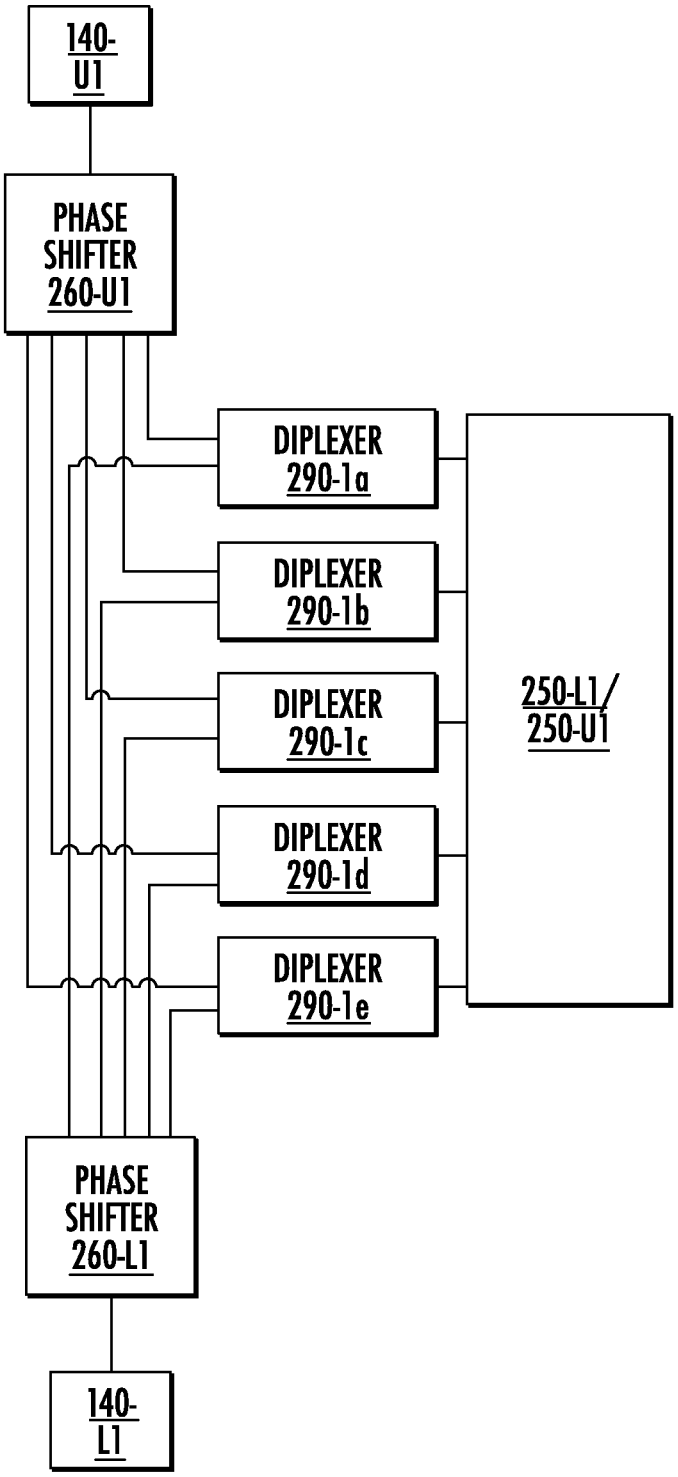
FIG. 2G is a schematic block diagram of a vertical column of FIG. 2B electrically connected to a lower-band antenna port and an upper-band antenna port.
Figure 2H:
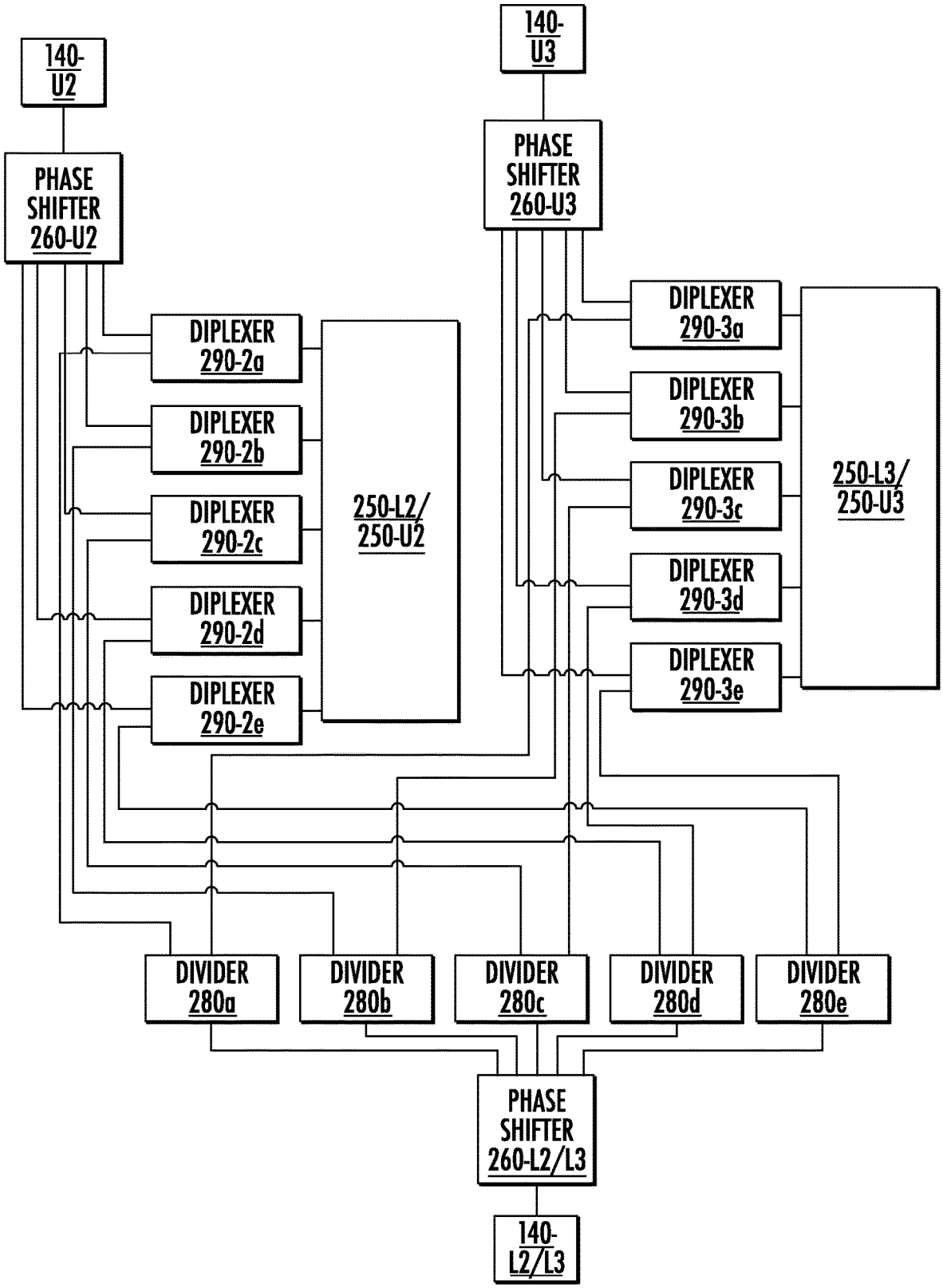
FIG. 2H is a schematic block diagram of a commonly-fed vertical column of FIG. 2B.
Figure 21:
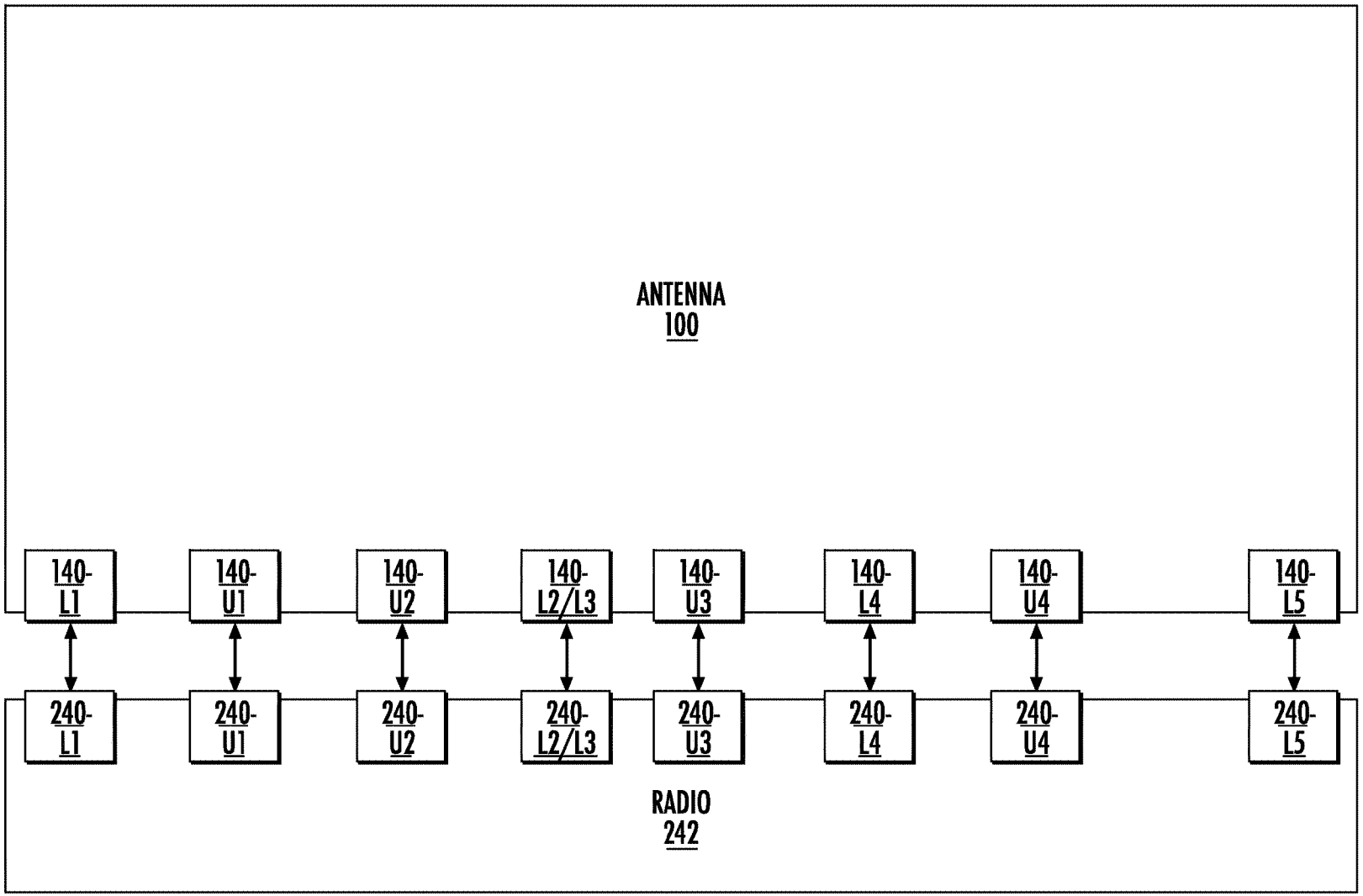

FIG. 2F is a schematic block diagram of a vertical column 250-L5 of FIG. 2B electrically connected to a lower-band port 140-L5 of the antenna 100 (FIG. 1). The ports 140 (FIG. 1) of the antenna 100 include upper frequency band ports 140-U that are electrically connected to respective upper frequency band phase shifters 260-U (FIGS. 2G and 2H). The ports 140 of the antenna 100 also include lower frequency band ports 140-L that are electrically connected to respective lower frequency band phase shifters 260-L, respectively. As the vertical column 250-L5 is used only in the lower frequency band, however, it is not electrically connected to an upper-band port 140-U.

Figure 5A:
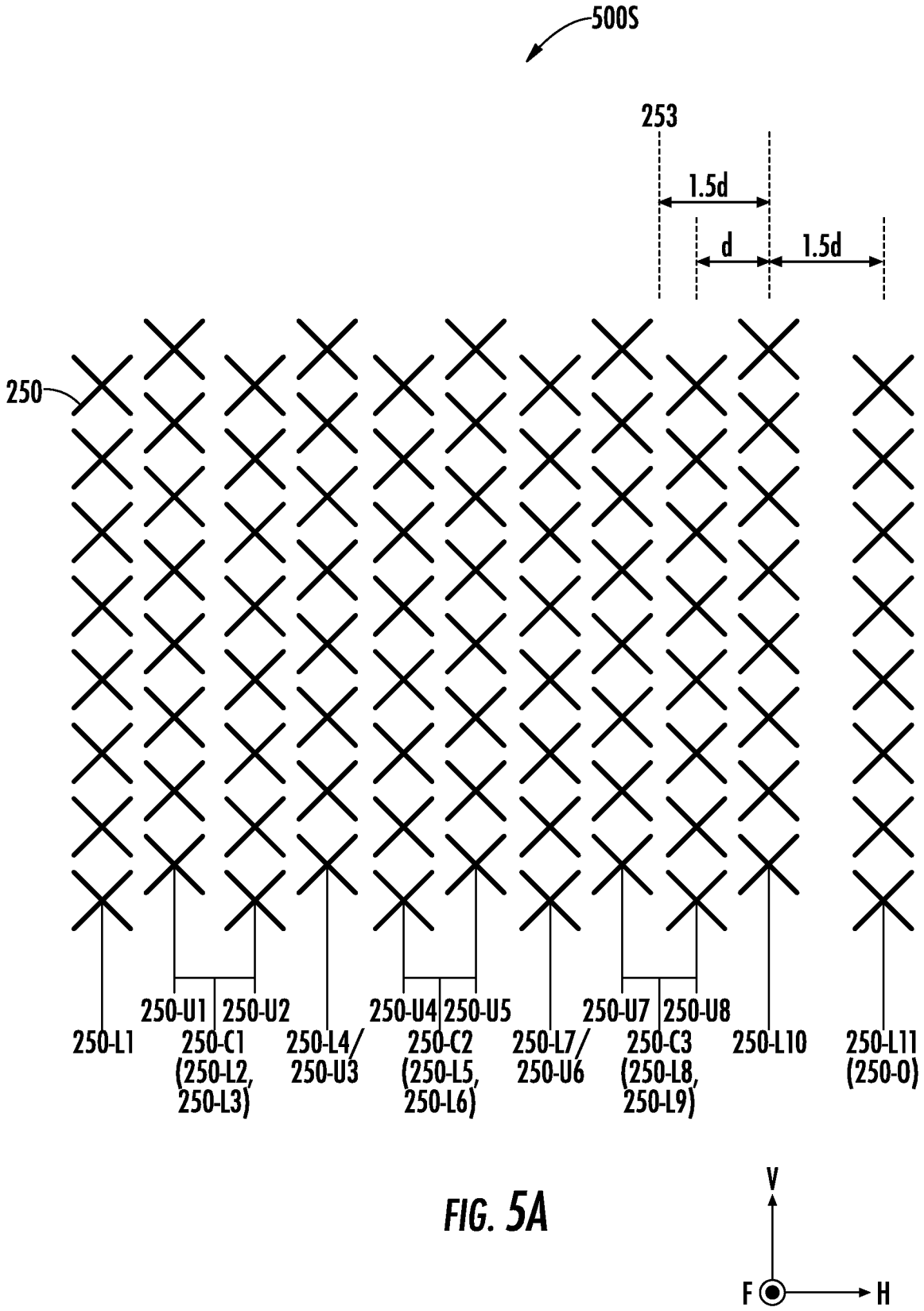
FIGS. 5A-5D are example schematic front views of the base station antenna of FIG. 1 with the radome removed.
Figure 5B:
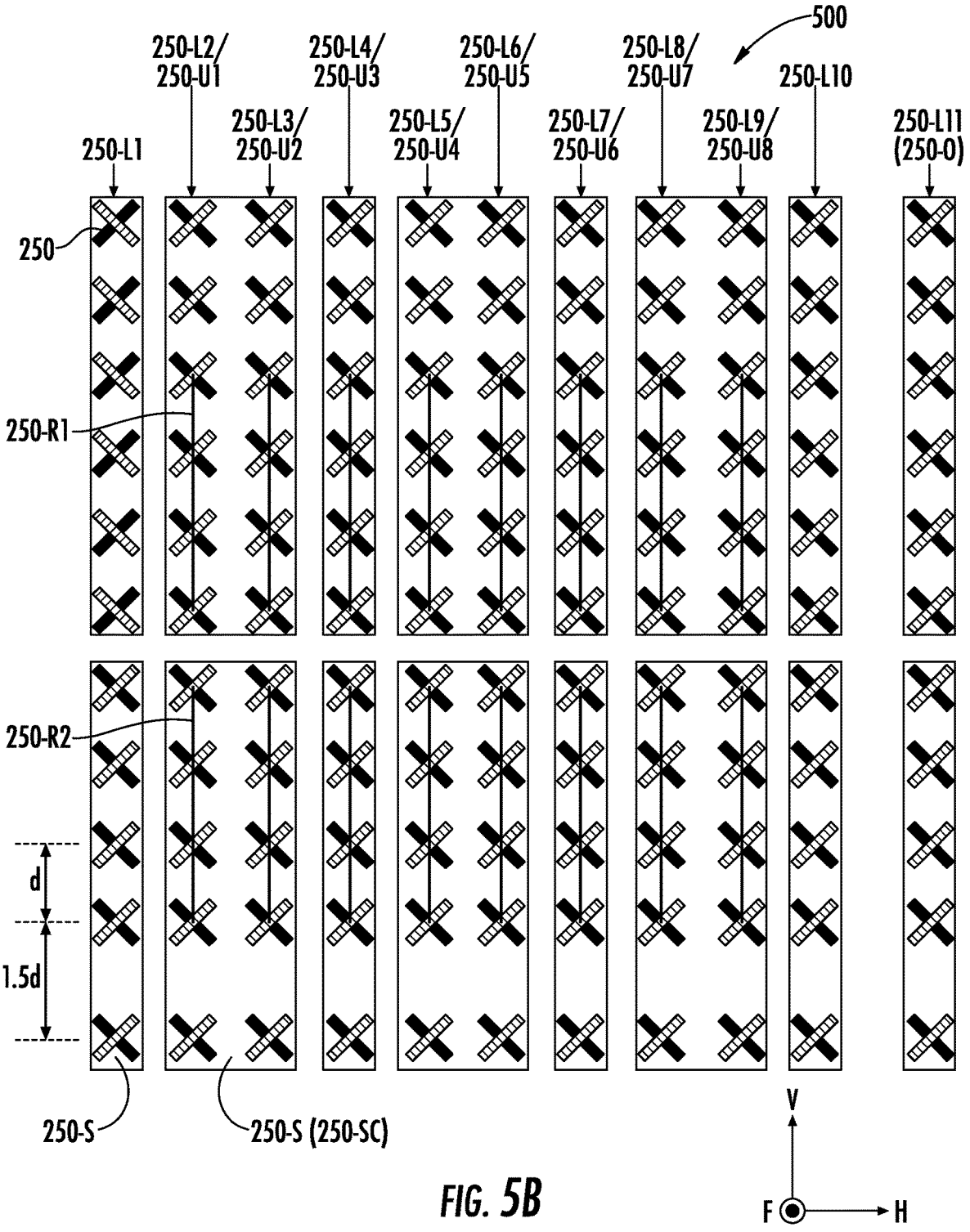
Figure 5C:
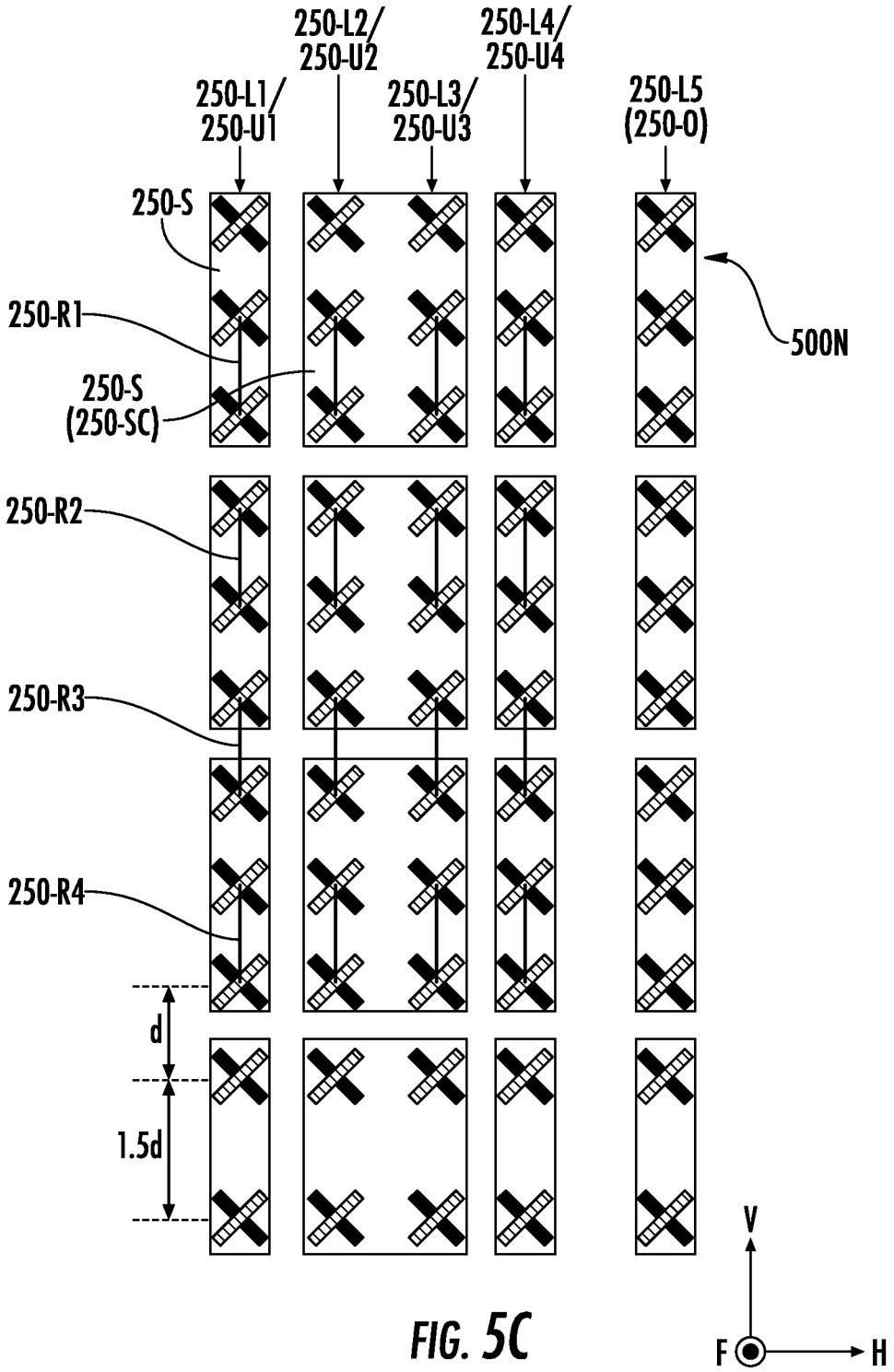
Figure 5D:
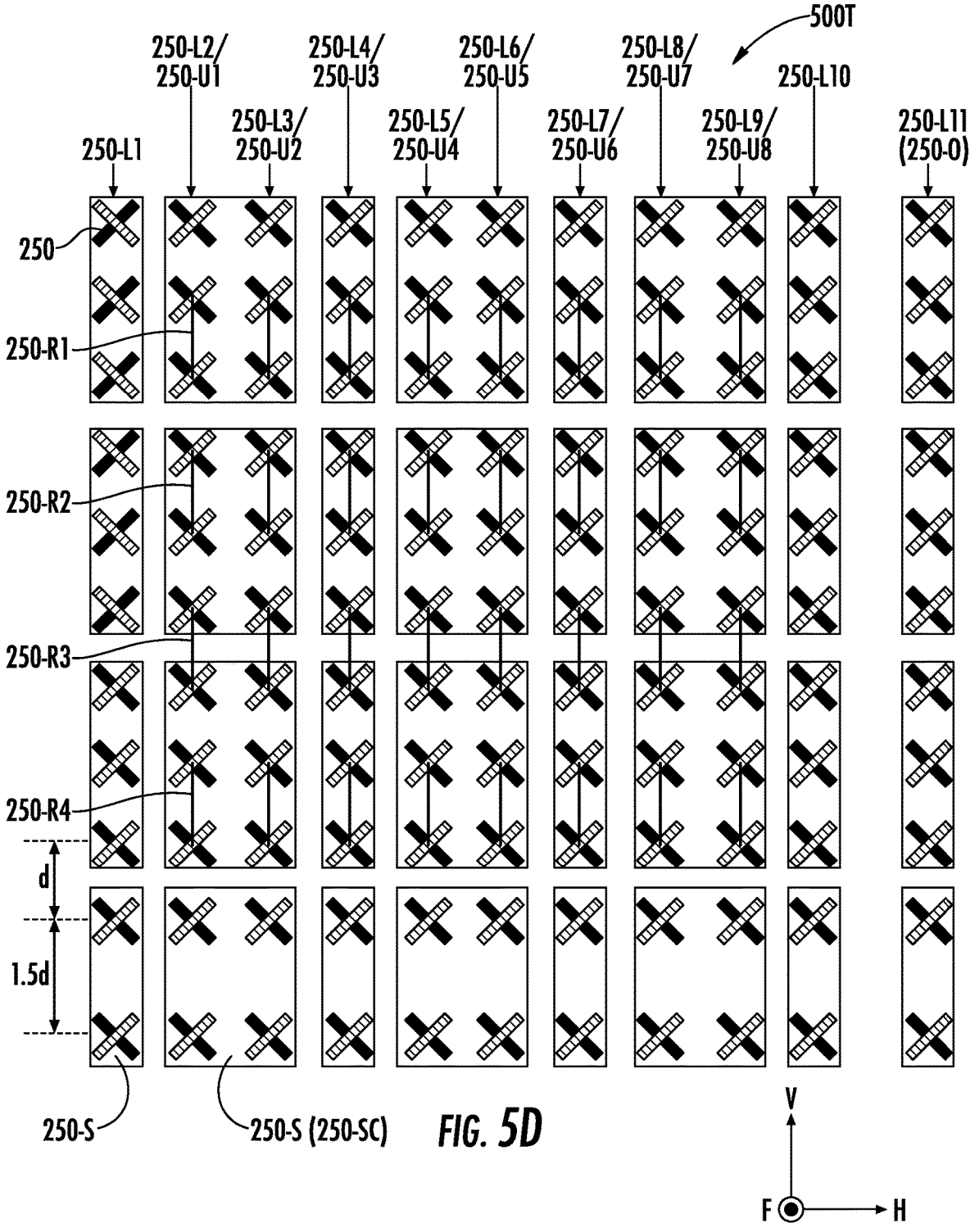
Figure 5E:
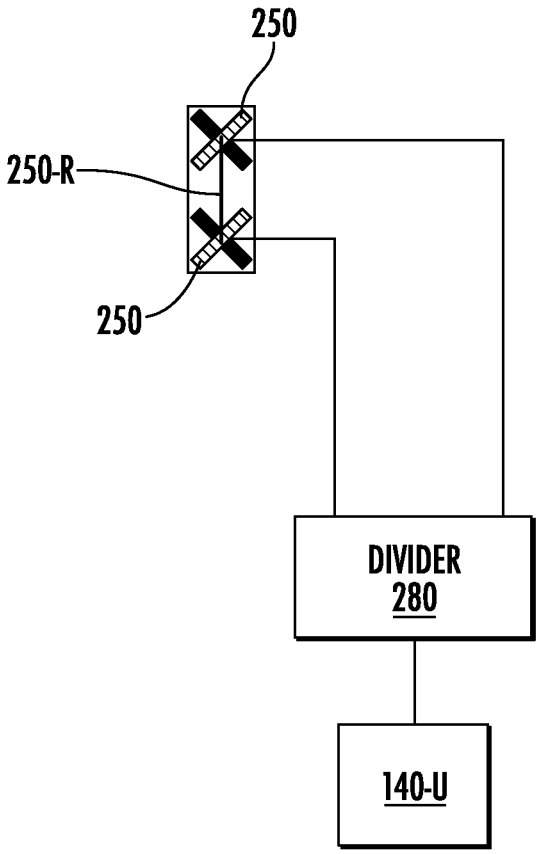
FIG. 5E is a schematic block diagram of a port that is connected to multiple radiating elements of a combined row.

Each port 140-L and 140-U may be electrically connected to one or more radiating elements 250 via a phase shifter 260 and/or a power divider 280 (FIGS. 2H and 5E). For example, a divider 280 may be used instead of a phase shifter 260 to connect a port 140 to a small number (e.g., one, two, three, or four) of radiating elements 250. For three, four, or more radiating elements 250, however, it may be beneficial to use a phase shifter 260. The ports 140-L may be beam-former ports for RF signals at the lower frequency band, and the ports 140-U may be beam-former ports for RF signals at the upper frequency band.

The vertical column 250-L5 may be electrically connected to the lower-band port 140-L5 via a lower frequency band phase shifter 260-L5. For example, five sub-arrays of radiating elements 250 of the vertical column 250-L5 may be coupled to respective outputs of the phase shifter 260-L5. Each sub-array may include two or three radiating elements 250. Moreover, in some embodiments, the vertical column 250-L5 may include four sub-arrays, rather than five, that are coupled to respective outputs of the phase shifter 260-L5.

FIG. 2G is a schematic block diagram of a vertical column 250-L1/250-U1 of FIG. 2B electrically connected to a lower-band port 140-L1 of the antenna 100 (FIG. 1) and an upper-band port 140-U1 of the antenna 100 via diplexers 290-*la* through 290-1*e*. The diplexers 290-1 facilitate sharing of the vertical column 250-L1/250-U1 between (a) use in the lower frequency band and (b) use in the upper frequency band. The outermost vertical column 250-L5 (FIG. 2F), by contrast, is not electrically connected to a diplexer 290 because it is used only in the lower frequency band. In some embodiments, the diplexers 290-1 may be on individual feeding boards 204, respectively.

Each diplexer 290-1 is electrically connected to an upper frequency band phase shifter 260-U1 and a lower frequency band phase shifter 260-L1. In particular, the diplexers 290-1*a* through 290-1*e* are coupled to respective outputs of the lower frequency band phase shifter 260-L1 and to respective outputs of the upper frequency band phase shifter 260-U1. The use of separate phase shifters for the upper and lower frequency bands facilitates independent tilt. Though the diplexers 290-1 are shown in FIG. 2G as being coupled to outputs of the phase shifters 260-L1 and 260-U1, diplexers 290 of the antenna 100 may, in some embodiments, be coupled between ports 140 and inputs of the phase shifters 260.

A vertical column 250-L4/250-U4 (FIG. 2B) may be electrically connected to a lower-band port 140-L4 (FIG. 2I) and an upper-band port 140-L4 (FIG. 2I). These connections are similar to those shown in FIG. 2G with respect to the vertical column 250-L1/250-U1 and the ports 140-L1 and 140-U1, and a detailed description/illustration thereof may thus be omitted herein.

FIG. 2H is a schematic block diagram of a commonly-fed vertical column 250-C of FIG. 2B. For the upper frequency band, the vertical column 250-U2 is electrically connected to an upper-band port 140-U2 of the antenna 100 (FIG. 1) similarly to the vertical column 250-U1 and the port 140-U1 as discussed with respect to FIG. 2G. Also, the vertical column 250-U3 is similarly electrically connected to an upper-band port 140-U3 of the antenna 100. Accordingly, the vertical columns 250-U2 and 250-U3 are electrically connected to different ports 140-U2 and 140-U3, respectively, for the upper frequency band.

For the lower frequency band, however, the commonly-fed pair of vertical columns 250-L2 and 250-L3, which collectively provide the commonly-fed vertical column 250-C, are electrically connected to the same port 140-L2/L3 of the antenna 100. A lower frequency band phase shifter 260-L2/L3 couples the shared port 140-L2/L3 to the commonly-fed pair of vertical columns 250-L2 and 250-L3. Moreover, power dividers 280*a* through 280*e* couple respective outputs of the lower frequency band phase shifter 260-L2/L3 to the commonly-fed pair of vertical columns 250-L2 and 250-L3 via diplexers 290-2*a* through 290-2*e* and diplexers 290-3*a* through 290-3*e*. In some embodiments, the dividers 280 may be frequency-dependent power dividers.

The diplexers 290-2*a* through 290-2*e* are also coupled to respective outputs of an upper frequency band phase shifter 260-U2. Similarly, the diplexers 290-3*a* through 290-3*e* are coupled to respective outputs of an upper frequency band phase shifter 260-U3.

As FIGS. 2F-2H show configurations for one polarization, similar configurations may be provided for the opposite polarization when radiating elements 250 are dual-polarized radiating elements. The antenna 100 may thus include additional phase shifters 260, additional power dividers 280, additional diplexers 290, and additional RF ports 140-L and 140-U for the opposite polarization. The vertical columns 250-L1/250-U1 through 250-L4/250-U4 may be diplexed between the phase shifters 260 and the radiating elements 250 (as shown in FIGS. 2G and 2H) or, in an alternative configuration, between the RF ports 140 and the phase shifters 260. In this alternative configuration, the same electrical downtilt is applied to the antenna beams in both frequency bands.

FIG. 2I is a schematic block diagram of the ports 140-L and 140-U of FIGS. 2F-2H electrically connected to ports 240 of a radio 242. For example, the radio 242 may be a beam-forming radio of a base station, and the ports 240 may be beam-former ports. As shown in FIG. 2I, the upper frequency band ports 140-U1 through 140-U4 of the antenna 100 (FIG. 1) are electrically connected to upper frequency band ports 240-U1 through 240-U4, respectively, of the radio 242. Similarly, the lower frequency band ports 140-L1, 140-L2/L3, 140-L4, and 140-L5 of the antenna 100 are electrically connected to lower frequency band ports 240-L1, 240-L2/L3, 240-L4, and 240-L5, respectively, of the radio 242.

Accordingly, the vertical column 250-L1/250-U1 may be fed by a single radio port 240-L1 per polarization at the lower frequency band and a single radio port 240-U1 per polarization at the upper frequency band. The vertical column 250-L4/250-U4 may similarly be fed by a single radio port 240-L4 per polarization at the lower frequency band and a single radio port 240-U4 per polarization at the upper frequency band. The outermost vertical column 250-O (250-L5) may be fed by a single radio port 240-L5 per polarization at the lower frequency band. At the lower frequency band, the combined vertical column 250-C (250-L2 and 250-L3) may be fed by a single radio port 240-L2/L3 per polarization. By contrast, at the upper frequency band, the vertical column 250-U2 may be fed by a single radio port 240-U2 per polarization, and the vertical column 250-U3 may similarly be fed by a single radio port 240-U3 per polarization.

For simplicity of explanation, FIGS. 2E-2I are discussed herein with respect to the antenna assembly 200S of FIG. 2B. In some embodiments, however, the components shown in FIGS. 2E-2I may be expanded/replicated to analogously connect to the larger antenna assembly 200 that is shown in FIG. 2A. For example, additional diplexers 290, dividers 280, phase shifters 260, and ports 140 and 240 may electrically connect to the additional vertical columns 250-U and 250-L of the larger antenna assembly 200.

Figure 3A:
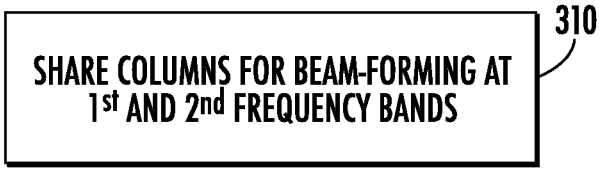
FIGS. 3A and 3B are flowcharts illustrating operations of a base station antenna, according to embodiments of the present inventive concepts.
Figure 3B:
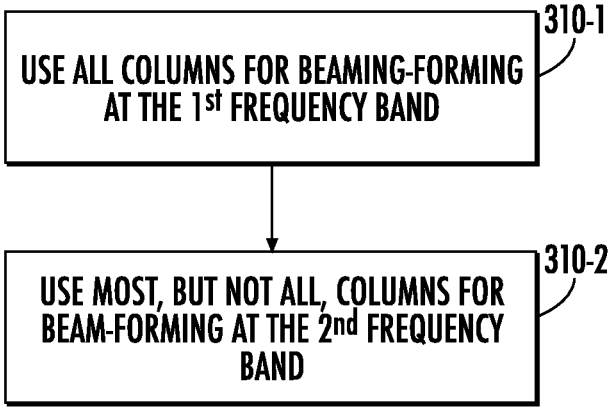

FIGS. 3A and 3B are flowcharts illustrating operations of a base station antenna 100 (FIG. 1). As shown in FIG. 3A, the antenna 100 may operate by sharing (Block 310) a plurality of vertical columns 250-L of radiating elements 250 (FIGS. 2A and 2B) for beam-forming at first and second frequency bands. The first frequency band may be lower than the second frequency band. For example, a ratio of a center frequency of the second frequency band to a center frequency of the first frequency band may be between 1.4 and 1.6.

Referring to FIG. 3B, the sharing (Block 310 of FIG. 3A) may comprise using all (Block 310-1) of the vertical columns 250-L for beam-forming at the first frequency band. The sharing may also comprise using a majority (Block 310-2) of the vertical columns 250-L, while refraining from using at least one of the vertical columns 250-L, for beam-forming at the second frequency band. For example, the antenna 100 may use all eleven (FIG. 2A) or all five (FIG. 2B) vertical columns 250-L for beam-forming at the first frequency band, and may refrain from using three (FIG. 2A) or one (FIG. 2B) vertical column(s) 250-L for beam-forming at the second frequency band.

At least one pair of the vertical columns 250-L may be commonly fed by the same radio port 240-L (FIG. 2I) for a particular polarization at the first frequency band. By contrast, the pair(s) of vertical columns 250-L may be fed by different respective radio ports 240-U per polarization at the second frequency band. In some embodiments, the antenna 100 may also include at least one vertical column 250-L that is fed by a single radio port 240-L per polarization at the first frequency band and a single radio port 240-U per polarization at the second frequency band.

For simplicity of explanation, FIGS. 3A and 3B are discussed herein using the reference designator 250-L to broadly refer to vertical columns of radiating elements 250 operating at the first frequency band and/or at the second frequency band. Particular ones of the vertical columns 250-L operating at both the first frequency band and the second frequency band, however, may also be designated herein as "250-L/250-U," as shown in FIGS. 2A and 2B.

Figure 4A:
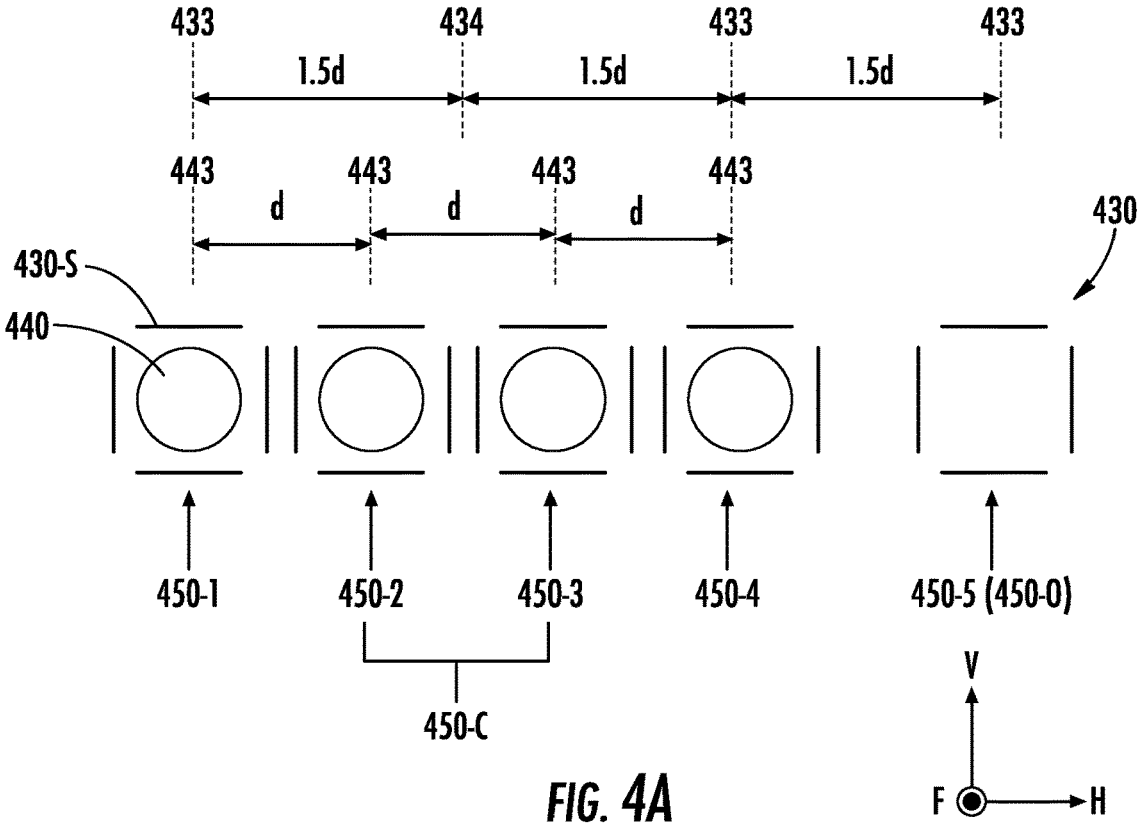
FIGS. 4A and 4B are example schematic front views of a row of narrower-band radiating elements, according to embodiments of the present inventive concepts.
Figure 4B:
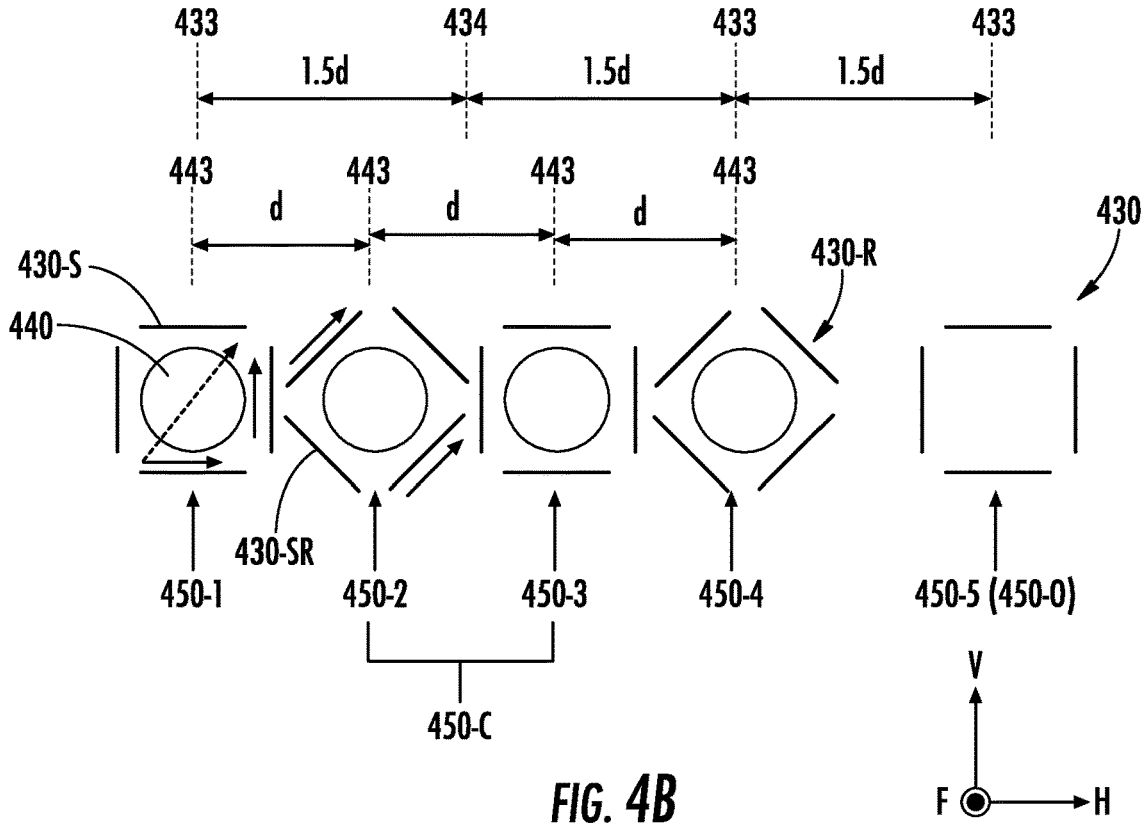

FIGS. 4A and 4B are example schematic front views of a row of lower-band radiating elements 430 and upper-band radiating elements 440 that may be used instead of wideband radiating elements 250. For simplicity of illustration, FIGS. 4A and 4B each show only one row. An array of a base station antenna 100 (FIG. 1), however, may include several (e.g., four, five, six, seven, eight, or more) rows of radiating elements 430 and 440. Moreover, though FIGS. 4A and 4B each show five vertical columns 450-1 through 450-5, more (e.g., six, seven, eight, or more vertical columns may be used, analogously to FIG. 2A.

Radiating elements 440 are absent from at least one vertical column 450 that operates only at the lower frequency band. For example, an outermost vertical column 450-O (450-5) may include only radiating elements 430, and thus may be free of any radiating elements 440. Also, radiating elements 430 of vertical columns 450-2 and 450-3 may be commonly fed to provide a combined vertical column 450-C at the lower frequency band. As a result, radiating elements 430 have a different spacing relative to radiating elements 440 in the horizontal direction H. For example, radiating elements 430 may have a larger center-to-center horizontal spacing (e.g., about 1.5d), and radiating elements 440 may have a shorter center-to-center horizontal spacing (e.g., about d). Vertical axes 433 are aligned with center points of radiating elements 430 in the vertical columns 450-1, 450-4, and 450-O, and vertical axes 443 are aligned with center points of radiating elements 440 in the vertical columns 450-1 through 450-4. Moreover, a vertical axis 434 is aligned with a virtual center of the combined vertical column 450-C.

Each radiating element 430 may include a plurality of segments 430-S, and each radiating element 440 may be between segments 430-S of a respective radiating element 430. For example, four segments 430-S of a respective radiating element 430 may be around each radiating element 440. As an example, each radiating element 440 may be in (e.g., in the center of) a respective radiating element 430 that comprises a box dipole element. In some embodiments, each radiating element 440 may be a patch radiating element, which may have a low profile and thus may not significantly impact performance of nearby radiating elements 430.

By using two different, relatively narrow-band radiating elements 430 and 440 instead of a wideband radiating element 250 that transmits RF signals in both upper and lower frequency bands, diplexers 290 (FIG. 2G) may be omitted for the vertical columns 450-1 through 450-O. Also, segments 430-S of radiating elements 430 may be relatively small and may have cloaking relative to the higher frequency band of radiating elements 440. Accordingly, radiating elements 430 and 440 may be used directly as individual elements for different frequency bands without needing a diplexer 290.

As is further shown in FIG. 4A, each radiating element 430 in a given row may have the same orientation. Segments 430-S in a first radiating element 430 may thus be symmetrical with segments 430-S in a consecutive second radiating element 430. For example, segments 430-S in each radiating element 430 may provide a respective box/rectangular shape having horizontally-extending sides that are parallel to the horizontal direction H and vertically-extending sides that are parallel to the vertical direction V.

By contrast, as shown in FIG. 4B, two or more radiating elements 430-R in a given row may be rotated relative to other radiating elements 430 in the row. For example, radiating elements 430-R in the vertical columns 450-2 and 450-4 may be rotated about forty-five degrees relative to radiating elements 430 in the vertical columns 450-1, 450-3, and 450-O. In particular, rotated segments 430-SR in a rotated radiating element 430-R may define acute angles with adjacent segments 430-S in a consecutive non-rotated radiating element 430. By alternating between the segments 430-S and the rotated segments 430-SR for consecutive non-rotated and rotated radiating elements 430 and 430-R, coupling therebetween can be reduced.

Moreover, the rotated segments 430-SR may be electrically excited differently from the segments 430-S to maintain the same polarization as each other. For example, as shown in FIG. 4B, two adjacent (e.g., third and fourth) segments 430-S in the first radiating element 430 are excited perpendicularly (shown as the solid arrows) to the positive 45-degree polarization (shown as the dashed arrow) that can be realized after vector combination of the two adjacent segments 430-S. To provide the same polarization, two parallel (e.g., first and third) rotated segments 430-SR in the consecutive second radiating element 430-R are excited in parallel (as shown in the solid arrows) to the positive 45-degree direction.

Also, as it may be desirable for the pattern performance of each radiating element 430 and 430-R in FIG. 4B to be similar for beam-forming, the distance between two adjacent rotated segments 430-SR may be different from the distance between two adjacent segments 430-S, to compensate for the effect of different excitation for rotated and non-rotated segments 430-SR and 430-S. For example, rotated segments 430-SR may be shorter (or longer) and/or narrower (or wider) than non-rotated segments 430-S. The rotated and non-rotated radiating elements 430-R and 430 may thus have structural differences beyond the different angles of the segments 430-SR and 430-S.

FIGS. 5A-5D are example schematic front views of the base station antenna 100 of FIG. 1 with the radome 110 thereof removed to illustrate an antenna assembly of the antenna 100. Referring to FIG. 5A, a 16T16R antenna assembly 500S may include vertical columns 250-U and 250-L that are staggered relative to each other in the vertical direction V. Though the vertical columns 250-U and 250-L are each shown as having eight radiating elements 250, they each may alternatively have nine, ten, eleven, or more radiating elements 250. For example, to achieve beam-forming in multiple directions, it may be advantageous to use a large number of radiating elements 250.

Moreover, though FIGS. 5B-5D illustrate non-staggered vertical columns 250-U and 250-L in (i) a 32T32R antenna assembly 500, (ii) a narrower 32T32R antenna assembly 500N, and (iii) a 64T64R antenna assembly 500T, respectively, non-staggered arrangements are not limited to 32T32R and 64T64R antenna assemblies. Rather, the 16T16R antenna assembly 500S may, in some embodiments, be non-staggered, as may an 8T8R antenna assembly. For massive multiple-input, multiple-output ("MIMO") operations with 32T32R, 64T64R, or larger antenna assemblies, it may be advantageous to use non-staggered arrangements.

As shown in FIG. 5A, some of the vertical columns 250-L of the antenna assembly 500S may be commonly fed for the lower frequency band. Specifically, the vertical columns 250-L2 and 250-L3 are commonly fed in FIG. 5A, as are the vertical columns 250-L5 and 250-L6 and the vertical columns 250-L8 and 250-L9. In FIG. 5A, these three pairs of commonly-fed vertical columns are designated as 250-C1, 250-C2, and 250-C3, respectively. The five vertical columns 250-L1, 250-L4, 250-L7, 250-L10, and 250-L11, by contrast, are each individually fed for the lower frequency band.

Also, the eight vertical columns 250-U1 through 250-U8 are each individually fed for the upper frequency band. These eight consecutive vertical columns 250-U1 through 250-U8 are also each configured to transmit RF signals in the lower frequency band. Accordingly, the eight vertical columns 250-U1 through 250-U8 are designated in FIG. 5A as both upper-band vertical columns 250-U and lower-band vertical columns 250-L.

Similar to the antenna assemblies 200 and 200S that are discussed herein with respect to FIGS. 2A-2D, the outermost vertical column 250-O in the antenna assembly 500S may have a larger horizontal spacing than other vertical columns in the antenna assembly 500S. For example, the outermost vertical column 250-O may have a horizontal spacing of about 1.5d that corresponds to a ratio of about 1.5 between the lower frequency band and the upper frequency band of the antenna assembly 500S. Any two (or more) frequency bands with a ratio of center frequencies between about 1.4 and 1.6 (or between about 1.3 and 1.7) may be used.

Referring to FIGS. 5B-5D, rectangular shapes that surround multiple radiating elements 250 indicate different sub-arrays 250-S, which may be on different respective feed boards 204 (FIG. 2E). For example, the antenna assembly 500 (FIG. 5B) has two rows of eight sub-arrays 250-S. By contrast, the antenna assembly 500N (FIG. 5C) has four rows of four sub-arrays 250-S and the antenna assembly 500T (FIG. 5D) has four rows of eight sub-arrays 250-S. Sub-arrays 250-S that include radiating elements 250 from multiple vertical columns that are commonly fed for the lower frequency band may be referred to herein as commonly-fed sub-arrays 250-SC.

A bottom row of radiating elements 250 may have a larger (e.g., about 1.5d) vertical spacing than other rows and may include only low-band radiating elements. Due to the larger vertical spacing, bottom sub-arrays 250-S may have fewer radiating elements 250 than corresponding vertically overlapping (e.g., top and/or middle) sub-arrays 250-S. For example, the bottom sub-arrays 250-S in FIG. 5C each have two (or four, for the commonly-fed sub-array 250-SC) radiating elements 250, whereas the top sub-arrays 250-S and the middle sub-arrays 250-S each include three (or six, for the commonly-fed sub-arrays 250-SC) radiating elements 250. Alternatively, a top row of radiating elements 250 may include only low-band radiating elements that are in top sub-arrays 250-S that have fewer radiating elements 250 than corresponding sub-arrays 250-S that are vertically overlapped by the top sub-arrays 250-S. For example, the top and bottom sub-arrays 250-S that are shown in FIG. 5C may be swapped.

FIGS. 5B-5D also show combined rows 250-R of radiating elements 250 for the upper frequency band. Each combined row 250-R may include two, three, four, or more radiating elements 250 that are in the same vertical column 250-U. For dual-polarized radiating elements 250, each combined row 250-R may be coupled to two upper-band input ports 140-U (FIG. 2I), thus providing one port 140-U per polarization. The radiating elements 250 in the combined rows 250-R may also operate in the lower frequency band and thus may be further coupled to two lower-band input ports 140-L (FIG. 2I) (one port 140-L per polarization) per sub-array 250-S. Moreover, radiating elements 250 that are not in a combined row 250-R may not operate in the upper frequency band and thus may be coupled to only ports 140-L and not to ports 140-U. A commonly-fed sub-array 250-SC may include multiple combined rows 250-R and thus may be coupled to more ports 140-U than ports 140-L. For example, a commonly-fed sub-array 250-SC may include two combined rows 250-R in respective vertical columns. As a result, the commonly-fed sub-array 250-SC may be coupled to four ports 140-U (two per polarization) and two ports 140-L (one per polarization).

Referring to FIG. 5D, because the antenna assembly 500T has more sub-arrays 250-S than the antenna assembly 500 (FIG. 5B) or the antenna assembly 500N (FIG. 5C), it uses more ports 140 (FIG. 2I). The antenna assembly 500T may thus provide better beam-forming performance, due to an increased range for scanning a service beam. Moreover, the antenna assembly 500N may use fewer radiating elements 250, and thus may take up less space in the horizontal direction H, than the antenna assembly 500 by stacking more (and smaller) sub-arrays 250-S in the vertical direction V.

Each sub-array 250-S in FIGS. 5B-5D is stacked in the vertical direction V with at least one other sub-array 250-S, and each stack of sub-arrays 250-S may thus be referred to herein as a "vertical stack" of sub-arrays 250-S. For example, FIGS. 5B and 5D illustrate eight vertical stacks and FIG. 5C illustrates four vertical stacks. In some embodiments, one or more of the vertical stacks may be a stack of commonly-fed sub-arrays 250-SC, and thus may include two vertical columns of radiating elements 250. Most of the vertical stacks, however, may have a single vertical column of radiating elements 250. As an example, the antenna assembly 500N (FIG. 5C) includes (i) a first vertical stack of four sub-arrays 250-S of radiating elements 250 in the vertical column 250-L1/250-U1, (ii) a second vertical stack of four sub-arrays 250-S of radiating elements 250 in commonly-fed vertical columns 250-L2/250-U2 and 250-L3/250-U3, (iii) a third vertical stack of four sub-arrays 250-S of radiating elements 250 in the vertical column 250-L4/250-U4, and (iv) a fourth vertical stack of four sub-arrays 250-S of radiating elements 250 in the vertical column 250-L5.

Moreover, as shown in FIGS. 5C and 5D, a combined row 250-R may span multiple sub-arrays 250-S. For example, four vertical columns 250-L1/250-U1 through 250-L4/250-U4 in the antenna assembly 500N (FIG. 5C) may each include a combined row 250-R3 that includes a first wideband radiating element 250 of one sub-array 250-S and a second wideband radiating element 250 of another sub-array 250-S.

The vertically-stacked sub-arrays 250-S shown in FIGS. 5B-5D may advantageously achieve 32T32R, 64T64R, or larger antenna assemblies without doubling the number of radiating elements 250 that are in a 16T16R antenna assembly. For example, the 32T32R antenna assembly 500 (FIG. 5B), the narrower 32T32R antenna assembly 500N (FIG. 5C), or the 64T64R antenna assembly 500T (FIG. 5D) may (a) incorporate vertically-stacked sub-arrays 250-S while (b) using fewer than double the number of radiating elements 250 per vertical column than the 16T16R antenna assembly 500S (FIG. 5A). The vertically-stacked sub-arrays 250-S may thus be a space-efficient way to achieve 32T32R, 64T64R, or larger antenna assemblies.

FIG. 5E is a schematic block diagram of a port 140-U that is connected to multiple radiating elements 250 of a combined row 250-R. In particular, the radiating elements 250 are fed by the same power divider 280, which is coupled to the port 140-U. For simplicity of illustration, a single port 140-U is shown for one polarization at the upper frequency band. The combined row 250-R may also be coupled, however, to a second upper-band port 140-U for a second polarization, and a sub-array 250-S (FIGS. 5B-5D) that includes the combined row 250-R may be coupled to two lower-band ports 140-L (FIG. 2I) (i.e., one port 140-L per polarization at the lower frequency band).

Figure 5F:
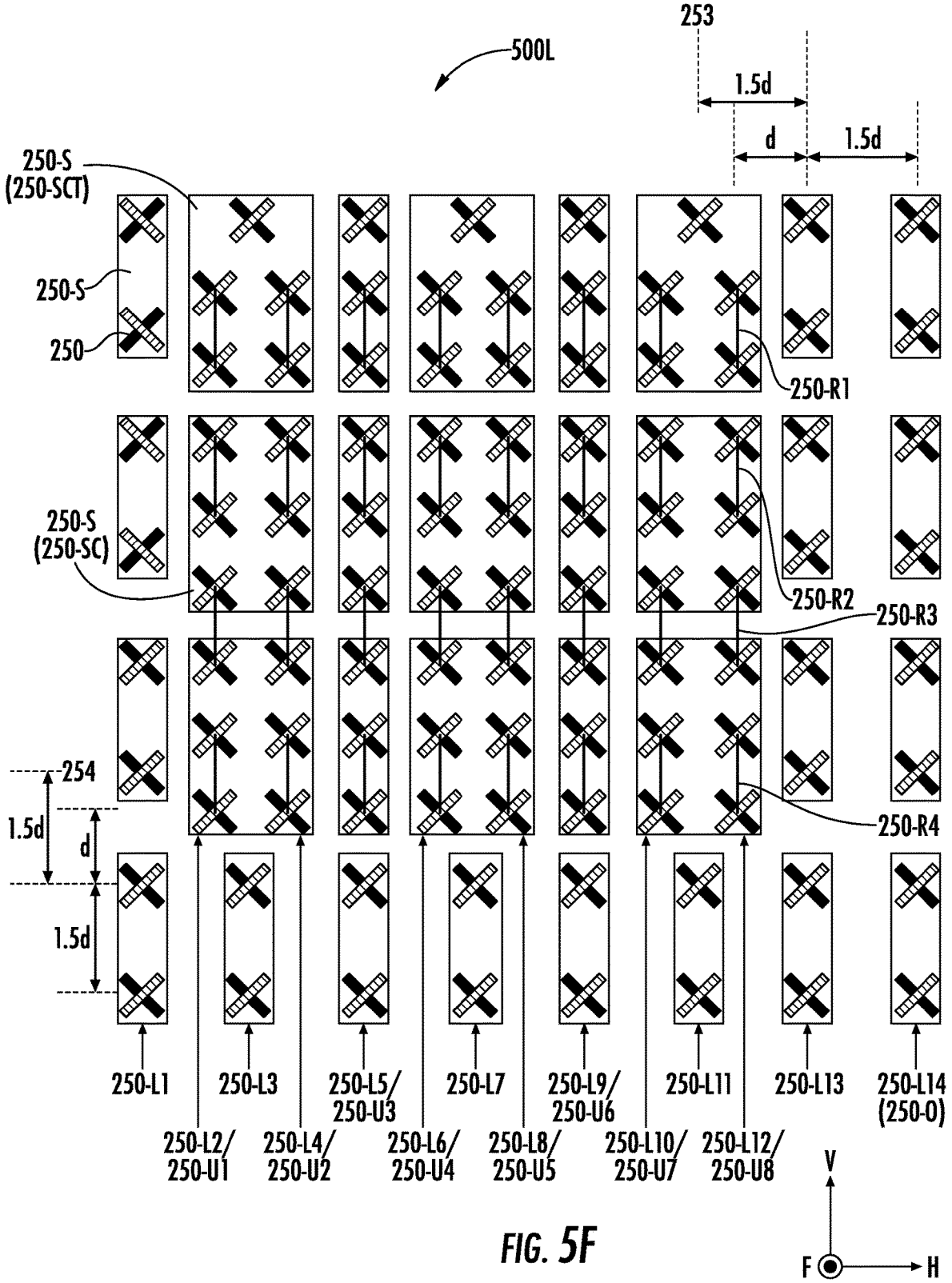
FIG. 5F is an example schematic front view of the base station antenna of FIG. 1 with the radome removed.

FIG. 5F is an example schematic front view of the base station antenna 100 of FIG. 1 with the radome 110 thereof removed to illustrate an antenna assembly 500L of the antenna 100. For massive MIMO (e.g., 32T32R, 64T64R, or larger) antenna assemblies, vertical columns that include only low-band radiating elements (among the radiating elements 250), can have a relatively large (e.g., 1.5d) spacing in both the vertical direction V and the horizontal direction H. For example, the antenna assembly 500L shows low-band-only vertical columns 250-L1, 250-L3, 250-L7, 250-L11, 250-L13, and 250-L14, which, as a result of larger vertical spacing, each include fewer radiating elements 250 than any of the wideband vertical columns 250-L2/250-U1, 250-L4/250-U2, 250-L5/250-U3, 250-L6/250-U4, 250-L8/250-U5, 250-L9/250-U6, 250-L10/250-U7, and 250-L12/250-U8.

Moreover, the low-band-only vertical columns 250-L3, 250-L7, and 250-L11 of the antenna assembly 500L include (a) bottom (or top) sub-arrays 250-S that are narrower than (b) other sub-arrays 250-S in vertical stacks that include the low-band-only vertical columns 250-L3, 250-L7, and 250-L11. As an example, the bottom sub-array 250-S in the low-band-only vertical column 250-L11 is narrower and horizontally centered (e.g., aligned with a virtual center 253 that is between two commonly-fed vertical columns 250-L10 and 250-L12) with respect to overlying commonly-fed sub-arrays 250-SC that are in the same vertical stack as the bottom sub-array 250-S.

In some embodiments, a commonly-fed sub-array 250-SC of the antenna assembly 500L may include a single radiating element 250 that is offset in the horizontal direction H from any other radiating element 250 in the sub-array 250-SC. For example, a top (or bottom) commonly-fed sub-array 250-SCT may have a top (or bottom) row that has a single low-band-only radiating element, which may be horizontally centered (e.g., aligned with a virtual center 253) in the sub-array 250-SCT. As an example, the low-band-only vertical columns 250-L3, 250-L7, and 250-L11 may each include a low-band-only radiating element that is horizontally offset from any other radiating element 250 in its sub-array 250-SCT. Moreover, a sub-array 250-S that has only low-band radiating elements may include a radiating element 250 that is aligned in the horizontal direction H with a virtual center 254 of a combined row 250-R.

The increased vertical and horizontal spacing of low-band-only radiating elements (e.g., dipoles) in the vertical antenna assembly 500L may advantageously result in better isolation. This increased spacing may also reduce the total number of radiating elements 250 in the antenna 100, and thus may be more cost effective. Moreover, by using fewer radiating elements 250 in some of the sub-arrays 250-S, fewer (e.g., one rather than two) power dividers 280 (FIG. 5G) may be coupled to each of those sub-arrays 250-S, thus providing an antenna assembly 500L that is easier to design.

Figure 5G:
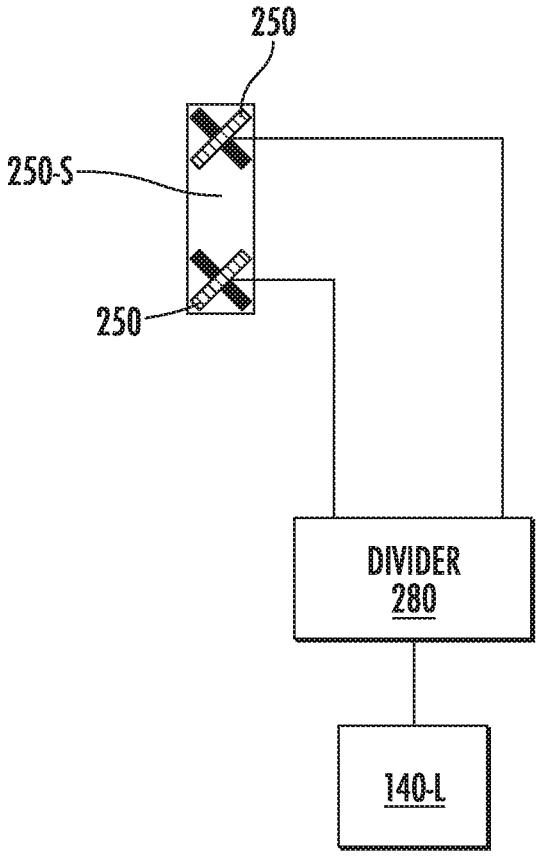
FIG. 5G is a schematic block diagram of a port that is connected to multiple radiating elements of a sub-array.

FIG. 5G is a schematic block diagram of a port 140-L that is connected to multiple radiating elements 250 of a sub-array 250-S. In particular, the radiating elements 250 are fed by the same power divider 280, which is coupled to the port 140-L. For simplicity of illustration, a single port 140-L is shown for one polarization at the lower frequency band. The sub-array 250-S may also be coupled, however, to a second lower-band port 140-L (and a second power divider 280) for a second polarization. In some embodiments, each sub-array 250-S may be coupled to one lower-band port 140-L per polarization. For example, a top commonly-fed sub-array 250-SCT (FIG. 5F) may be coupled to a first pair of lower-band ports 140-L (one per polarization), and an adjacent low-band-only sub-array 250-S (FIG. 5F) may be coupled to a second pair of lower-band ports 140-L (one per polarization).

Moreover, in some embodiments, each sub-array 250-S may be on its own respective feed board 204 (FIG. 2E), which may receive two inputs from the radio side (two polarizations). Because each sub-array 250-S has multiple radiating elements 250, it may benefit from a power distribution network. For example, one or more power dividers 280 may be coupled to each sub-array 250-S. As an example, a sub-array 250-S that has three radiating elements 250 may be coupled to two dividers 280 per polarization, where each divider 280 has two outputs and one of the outputs of one of the dividers 280 is coupled to an input of a second of the dividers 280, thus splitting power three ways for the sub-array 250-S. As shown in FIG. 5F, however, some sub-arrays 250-S may have only two radiating elements 250, and thus may be coupled to only one divider 280 (rather than two) per polarization. Accordingly, having fewer radiating elements 250 in those sub-arrays 250-S can facilitate an easier design by reducing the number of dividers 280.

Figure 6:
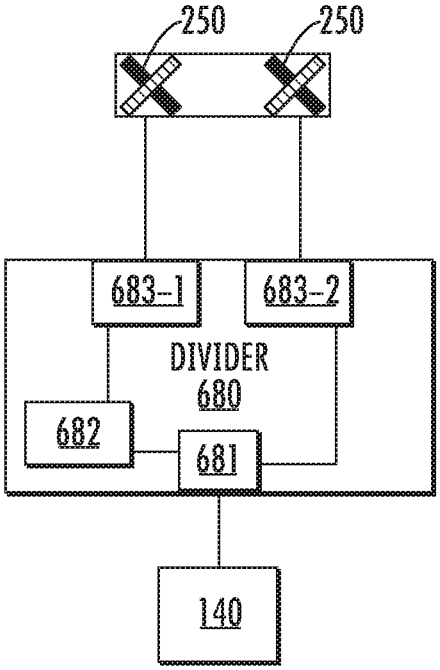
FIG. 6 is a schematic block diagram of a frequency-dependent power divider according to embodiments of the present inventive concepts.

FIG. 6 is a schematic block diagram of a frequency-dependent power divider 680 according to embodiments of the present inventive concepts. The divider 680 may comprise an input 681, multiple outputs 683, and a filter 682 that is coupled to some (but not all) of the outputs 683. For example, the filter 682 may be coupled between the input 681 and a first output 683-1, and may not be coupled between the input 681 and a second output 683-2. As a result, at least one frequency band that is output from the second output 683-2 may not be output from the first output 683-1. In particular, the filter 682 may be a bandpass filter that passes a lower frequency band (e.g., 2300-2690 MHz or a portion thereof) to the first output 683-1 and that rejects an upper frequency band (e.g., 3300-3800 MHz or a portion thereof). By contrast, the second output 683-2 may output both the lower frequency band and the upper frequency band because the filter 682 is not coupled between the input 681 and the second output 683-2.

As a result of the divider 680, a first power level (e.g., 1 Watt) that is at the input 681 for the upper and lower frequency bands may be divided in half (e.g., 0.5 Watts) to provide a second power level at both the first output 683-1 and the second output 683-2 for the lower frequency band. Moreover, the second output 683-2 may receive the full, unfiltered first power level for the upper frequency band, whereas the filter 682 may result in a lower, third power level (e.g., 0 Watts) at the first output 683-1 for the upper frequency band.

In some embodiments, the divider 680 may be coupled between a port 140 (FIG. 1) and a pair of radiating elements 250 that are in different vertical columns. For example, the port 140 may be coupled to the input 681 of the divider 680, a first radiating element 250 of a low-band-only vertical column may be coupled to the first output 683-1, and a second radiating element 250 of a wideband vertical column may be coupled to the second output 683-2. As an example, a first radiating element 250 of the low-band-only vertical column 250-L2 shown in FIG. 2A may be coupled to the first output 683-1, and a second radiating element 250 of the wideband vertical column 250-L3/250-U1 shown in FIG. 2A may be coupled to the second output 683-2.

In other embodiments, the divider 680 may be coupled between a port 140 and a pair of radiating elements 250 that are in the same vertical column. Doing so may help to control the vertical aperture for gain compensation for the lower frequency band. For example, the port 140 may be coupled to the input 681 of the divider 680, a first radiating element 250 of a vertical column may be coupled to the first output 683-1, and a second radiating element 250 of the same vertical column may be coupled to the second output 683-2. As an example, one of the low-band-only radiating elements 250 (e.g., the top radiating element 250 or one of the bottom two radiating elements 250) in the wideband vertical column 250-L3/250-U1 shown in FIG. 2A can be coupled to the first output 683-1, and one of the wideband radiating elements 250 in the same wideband vertical column 250-L3/250-U1 can be coupled to the second output 683-2. This same concept can be applied to all of the vertical columns. Accordingly, each vertical column may have a respective divider 680 coupled to a pair of radiating elements 250 therein.

Moreover, in some embodiments, multiple low-band-only radiating elements 250 may be coupled to the same first output 683-1 of the divider 680 and/or multiple wideband radiating elements 250 may be coupled to the same second output 683-2 of the divider 680. The divider 680 can advantageously facilitate using more (e.g., a relatively large quantity of) radiating elements 250 that operate in the lower frequency band to achieve a desired overall gain for an antenna/array, which typically needs a larger vertical array aperture for the lower frequency band. Otherwise (i.e., without the divider 680), overall gain may disadvantageously decrease compared with a traditional array.

A base station antenna 100 (FIG. 1) comprising shared vertical columns 250-L/250-U of radiating elements 250 configured to provide beam-forming at multiple frequency bands according to embodiments of the present inventive concepts may provide a number of advantages. These advantages, relative to beam-forming at multiple frequency bands without sharing vertical columns, include reducing the size (e.g., in the horizontal direction H) of the antenna 100 or preserving reflector 214 (FIG. 2E) space for radiating elements of additional frequency bands that the antenna 100 can use. The present inventive concepts can thus provide a space-efficient multiband beam-former.

For example, a beam-former that would otherwise use four vertical columns of radiating elements 250 for only a single frequency band may space-efficiently attain multi-band functionality using five (rather than eight) vertical columns. This can be achieved by adding an outermost fifth column 250-O (FIG. 2B) that operates at a lower frequency band and has a larger horizontal spacing (e.g., about 1.5d (FIG. 2D)), and by feeding two vertical columns together as one combined vertical column 250-C (FIG. 2B) at the lower frequency band. All five vertical columns may be used at the lower frequency band, and four may be used at the higher frequency band. Similarly, a beam-former that would otherwise use eight vertical columns for only a single frequency band may attain multiband functionality using eleven (rather than sixteen) vertical columns (FIG. 2A). Accordingly, rather than doubling the number of vertical columns to attain multiband functionality, the present inventive concepts can space-efficiently achieve this result with a more modest addition of column(s).

The use of one or more combined vertical columns 250-C, along with the spacing of the outermost column 250-O and the ratio of center frequencies, can facilitate operation in multiple frequency bands with limited adverse impact. In particular, the present inventive concepts can maintain spacing between vertical columns of about half of a wavelength despite sharing some of the vertical columns between multiple frequency bands. Accordingly, multiple frequency bands can radiate out of the same ones of a subset of the radiating elements 250 while providing acceptable beam-forming performance.

The present inventive concepts have been described above with reference to the accompanying drawings. The present inventive concepts are not limited to the illustrated embodiments. Rather, these embodiments are intended to fully and completely disclose the present inventive concepts to those skilled in this art. In the drawings, like numbers refer to like elements throughout. Thicknesses and dimensions of some components may be exaggerated for clarity.

Spatially relative terms, such as "under," "below," "lower," "over," "upper," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the example term "under" can encompass both an orientation of over and under. The device may be otherwise oriented (rotated 90 degrees or at other orientations) and the spatially relative descriptors used herein interpreted accordingly.

Herein, the terms "attached," "connected," "interconnected," "contacting," "mounted," and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the present inventive concepts. As used herein, the singular forms "a," "an," and "the" are intended to include the plural forms as well, unless the context clearly indicates otherwise. It will be further understood that the terms "comprises," "comprising," "includes," and/or "including" when used in this specification, specify the presence of stated features, operations, elements, and/or components, but do not preclude the presence or addition of one or more other features, operations, elements, components, and/or groups thereof.

That which is claimed is:

1. A base station antenna comprising:

a plurality of first frequency band ports that are configured to operate in a first frequency band;

a plurality of second frequency band ports that are configured to operate in a second frequency band, the first frequency band being lower than the second frequency band; and a multiband beam-former array having a plurality of vertical columns of radiating elements, wherein at least two of the plurality of vertical columns of radiating elements are commonly fed by a first of the first frequency band ports, wherein, for the first frequency band, all of the plurality of vertical columns of radiating elements are used for beam-forming, and wherein, for the second frequency band, a majority of the plurality of vertical columns of radiating elements are used for beam-forming and at least one of the plurality of vertical columns of radiating elements is not used for beam-forming.

2. The base station antenna of claim 1, wherein the plurality of vertical columns of radiating elements comprises:

first, second, third, and fourth vertical columns that are each configured to transmit radio frequency ("RF") signals in both the first frequency band and the second frequency band; and a fifth vertical column that is configured to transmit RF signals in the first frequency band and not in the second frequency band.

3. The base station antenna of claim 2, wherein the second and third vertical columns are commonly fed for the first frequency band.

4. The base station antenna of claim 2, wherein the first, the second, the third, the fourth, and the fifth vertical columns are five consecutive vertical columns.

5. The base station antenna of claim 4, wherein a center point of a radiating element of the second vertical column is spaced apart from a center point of a corresponding radiating element of the third vertical column by a first distance, and wherein a center point of a radiating element of the fifth vertical column is spaced apart from a center point of a corresponding radiating element of the fourth vertical column by a second distance that is between 1.3 and 1.7 times the first distance.

6. The base station antenna of claim 5, wherein the first distance is equal to about half of a wavelength of the second frequency band, and wherein the second distance is equal to about half of a wavelength of the first frequency band.

7. The base station antenna of claim 1, wherein the plurality of vertical columns of radiating elements comprises eleven vertical columns comprising:

eight consecutive vertical columns that are each configured to transmit radio frequency ("RF") signals in both the first frequency band and the second frequency band; and three vertical columns that are configured to transmit RF signals in the first frequency band and not in the second frequency band.

8. The base station antenna of claim 7, wherein five of the eleven vertical columns are individually fed for the first frequency band, and wherein a first pair of the eleven vertical columns are commonly fed for the first frequency band, a second pair of the eleven vertical columns are commonly fed for the first frequency band, and a third pair of the eleven vertical columns are commonly fed for the first frequency band.

9. The base station antenna of claim 8, wherein a first of the five of the eleven vertical columns is between the first pair and the second pair, and wherein a second of the five of the eleven vertical columns is between the second pair and the third pair.

10. The base station antenna of claim 7, wherein an outermost one of the eleven vertical columns is one of the three vertical columns and has a radiating element having a center point that is spaced apart from a center point of a corresponding radiating element of a nearest adjacent one of the eleven vertical columns by a second distance that is between 1.3 and 1.7 times a first distance between center points of radiating elements of others of the eleven vertical columns.

11. A base station antenna comprising:

a plurality of first frequency band ports that are configured to operate in a first frequency band;

a plurality of second frequency band ports that are configured to operate in a second frequency band, the first frequency band being lower than the second frequency band; and a multiband beam-former array having a plurality of vertical columns of radiating elements, wherein at least two of the plurality of vertical columns of radiating elements are commonly fed by a first of the first frequency band ports, and wherein at least one of the plurality of vertical columns of radiating elements is individually fed by a second of the first frequency band ports.

12. The base station antenna of claim 11, wherein the at least one of the plurality of vertical columns of radiating elements is not fed by any of the second frequency band ports.

13. The base station antenna of claim 12, wherein each of the plurality of vertical columns of radiating elements that is fed by a respective one of the second frequency band ports is individually fed thereby.

14. A base station antenna comprising:

a plurality of first frequency band ports that are configured to operate in a first frequency band;

a plurality of second frequency band ports that are configured to operate in a second frequency band, the first frequency band being lower than the second frequency band; and a multiband beam-former array having a plurality of vertical columns of radiating elements, wherein at least two of the plurality of vertical columns of radiating elements are commonly fed by a first of the first frequency band ports, wherein the radiating elements comprise first radiating elements that are configured to operate at the first frequency band and second radiating elements that are configured to operate at the second frequency band, wherein each of the second radiating elements is between a plurality of segments of a respective one of the first radiating elements, and wherein at least one of the plurality of vertical columns of radiating elements is configured to operate only at the first frequency band and does not include any of the second radiating elements.

15. The base station antenna of claim 14, wherein the first radiating elements comprise box dipole elements, respectively, and wherein the box dipole elements define acute angles relative to each other in consecutive ones of the plurality of vertical columns of radiating elements.

16. The base station antenna of claim 1, wherein the at least one of the plurality of vertical columns of radiating elements comprises:

a first of the plurality of vertical columns of radiating elements that is individually fed by a second of the first frequency band ports.

17. The base station antenna of claim 16, wherein the first of the plurality of vertical columns of radiating elements is the only one of the plurality of vertical columns of radiating elements that is not used for beam-forming for the second frequency band.

18. The base station antenna of claim 16, wherein the at least one of the plurality of vertical columns of radiating elements further comprises:

a second of the plurality of vertical columns of radiating elements that is individually fed by a third of the first frequency band ports.

19. The base station antenna of claim 11, wherein the at least one of the plurality of vertical columns of radiating elements comprises:

a first of the plurality of vertical columns of radiating elements that is individually fed by the second of the first frequency band ports; and a second of the plurality of vertical columns of radiating elements that is individually fed by a third of the first frequency band ports, and wherein the at least two of the plurality of vertical columns of radiating elements are between the first and the second of the plurality of vertical columns of radiating elements.

* * * * *